US007029334B2

(12) United States Patent
Shibuya

(10) Patent No.: US 7,029,334 B2
(45) Date of Patent: Apr. 18, 2006

(54) MULTI WAY CONNECTOR

(75) Inventor: Kazunari Shibuya, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/205,130

(22) Filed: Aug. 17, 2005

(65) Prior Publication Data

US 2006/0046577 A1 Mar. 2, 2006

(30) Foreign Application Priority Data

Aug. 27, 2004 (JP) ..... 2004-248896

(51) Int. Cl.
*H01R 24/00* (2006.01)

(52) U.S. Cl. ..... 439/660; 439/682

(58) Field of Classification Search ..... 439/660, 439/607, 682, 733.1
See application file for complete search history.

(56) References Cited

U.S. PATENT DOCUMENTS 5,618,191 A * 4/1997 Chikano et al. ..... 439/108
6,561,850 B1 * 5/2003 Letourneau et al. ..... 439/608
6,814,605 B1 * 11/2004 Masumoto ..... 439/353

FOREIGN PATENT DOCUMENTS

JP 2004-327244 11/2004

* cited by examiner

*Primary Examiner*—Tho D. Ta
*Assistant Examiner*—Vanessa Girardi
(74) *Attorney, Agent, or Firm*—Takeuchi&Kubotera, LLP

(57) ABSTRACT

A plurality of first and second type contact terminals (11 and 11-1) of a multi way connector, which have the same length of transmission path, are fitted in first and second terminal fit portions (19 and 19-1), respectively at a predetermined interval. The lead portions (22 and 22-1) of the contact terminals (19 and 19-1) project on the same side in a non-longitudinal direction of the connector. A pair of the contact terminals (19 and 19-1) constitutes a signal terminal 20 and another pair of contact terminals (19 and 19-1) constitutes a ground terminal 20-1, wherein the signal and ground terminal 20 and 20-1 are provided alternately in a longitudinal direction of the connector.

10 Claims, 20 Drawing Sheets

MULTI WAY CONNECTOR

BACKGROUND OF THE INVENTION

1. Field of the Invention

This invention relates to a multi way connector usable for transmitting electric information from an equipment body to an electronic apparatus, such as an LCD panel, especially a multi way connector having a receptacle connector and a cable connector as a mating connector.

2. Description of the Related Art

A multi way connector has been widely used for transmitting electric information from an equipment body to an LCD panel and so forth. Generally, the multi way connector comprises a receptacle connector mounted in the back of the LCD panel and a cable connector connected to a wiring from the equipment body. The electric information from the equipment body is transmitted to the LCD panel by connecting the receptacle and cable connectors.

A receptacle connector of a conventional multi way connector comprises a plurality of conductive contacts, conductive ground plate, an insulator, which holds the contacts and the ground plate, and a conductive shell. Each of the contact is made by bending a sheet metal after pressing. The contact comprises a press-fit portion, a spring portion extending from the press-fit portion in a direction, a curved contact portion formed at a free end of the spring portion, and a lead portion extending from the press-fit portion in the other direction for the purpose of soldering. The transmission path of each contact has an equal length.

The ground plate comprises a ground press-fit portion extending from a connection portion, which is long in a longitudinal direction of the connector, a ground spring portion, which extends from the ground press-fit portion in a direction, and a ground contact, which is bent from a free end of the ground spring portion toward a side of the contact.

The contacts are press-fitted into contact holes provided in the insulator such that the contacts are fixed and arranged at a predetermined interval (1 mm on the average because the contacts are connected to the cable connector) in the longitudinal direction of the connector. The lead portions are arranged on a side of the insulator. The ground plate is assembled into the insulator from the rear side of the insulator such that the ground press-fit portion of the ground plate is press-fitted into a ground plate hole of the insulator (refer to Patent Document 1).

PATENT DOCUMENT 1: Japanese Patent Application Kokai Number 3516163.

However, the above conventional connector, if the receptacle connector has multi conductors, has the following problems. The receptacle connector becomes long in the longitudinal direction of the connector (a pitch direction of the contacts) so that a large area or space is required to mount the receptacle connector on the back of the LCD panel. Also, the receptacle connector is thin in spite of its large length in the longitudinal direction of the connector. Consequently, the receptacle connector is not strong and the working efficiency upon insertion and removal of the cable connector is reduced. Further, since a "B to B connection" and a vertical mount are difficult because of the weakness of the receptacle connector, only a horizontal mount is available and a type pf the mating connector is limited only to the cable connector.

Recently, a differential signal transmission is proposed under the condition of accelerating of high speed signal. In the differential signal transmission, two signals having opposite phases from each other are transmitted in a pair of signal transmission lines to take the difference between the phases of the two signals, thereby to strengthen the resistance to noise.

The defective point of the differential signal transmission is that when common mode components are superimposed or overlapped with each other, the electromagnetic radiation noise is increased. One of the reasons of the generation of the common mode components is that the distal ends of the pair of the lines are inconsistent. An example of the inconsistency is a mismatching length of the pair of the lines.

SUMMARY OF THE INVENTION

Therefore, one of the objectives of the present invention is to provide a multi way connector, which has a small mount area in spite of multi conductors and is sufficiently strong so that the working efficiency upon insertion and removal of the mating connector is increased. Also, according to the multi way connector of the present invention, the mating connector is mountable on a circuit board and the connection method is diversified, that is, a vertical mount becomes possible.

In order to achieve the above object, a connector of a multi way connector according to the present invention comprises an insulation case, a connector plug-in section provided in the insulation case, and a plurality of first and second contact terminals provided in the connector plug-in section. A mating connector of the multi way connector comprises a mating insulation case, a mating connector plug-in section provided in the mating insulation case, and a plurality of mating contact terminals provided in the mating connector plug-in section. The mating connector plug-in section is plugged in the connector plug-in section so that the contact terminals are brought into contact with the mating contact terminals for conduction. The connector plug-in section has a plug-in protrusion in a front face thereof and two rows of plug-in spaces sandwiching the plug-in protrusion and extending in a longitudinal direction of the connector. The plug-in protrusion has first terminal fit portions opened to one row of the plug-in spaces and second terminal fit portions opened to the other row of the plug-in spaces, wherein the first and second terminal fit portions are alternately provided at a predetermined interval in the longitudinal direction of the connector. The first contact terminals fitted in the first terminal fit portions such that first contact portions of the first contact terminals are opened to the one row of the plug-in spaces and the second contact terminals fitted in the second terminal fit portions such that second contact portions of the second contact terminals are opened to the other row of the plug-in spaces. First lead portions of the first contact terminals and second lead portions of the second contact terminals project on the same side in a non-longitudinal direction of the connector and are provided at predetermined intervals in the longitudinal direction of the connector.

By the above construction, even if the connector is multi way type, since the intervals between the lead portions (mounted portions) are made a half of the intervals between the contact portions of the contact terminals (signal and ground terminals), the connector does not become large in the longitudinal direction (a direction of pitch or arrangement of the contacts) of the connector, thus making the mount area small. Also, since the interval between the contact portions of the signal and ground terminals can be designed large, the crimp-style cable connector is applicable as a mating connector.

Further, since the thickness in a widthwise direction (non-longitudinal direction of the connector) of the connector can be designed large to increase the strength of the connector so that the working efficiency upon insertion and removal of the mating connector is increased, a mating connector of a board mount type is applicable, and the connection method is diversified including a vertical mount. Even if the thickness of the connector becomes large, the size of the connector represented by the width×the length (a dimension of the non-longitudinal direction×a dimension of the longitudinal direction) of the connector is made relatively small with respect to the conventional connector.

According to another aspect of the invention, a pair of the first and second contact terminals of the connector constitutes a signal terminal and another pair of the first and second contact terminals constitutes a ground terminal and the signal and ground terminals are alternately provided in the longitudinal direction of the connector.

By the above construction, even if the connector is multi way type, since the intervals between the lead portions (mounted portions) are made a half of the intervals between the contact portions of the contact terminals (signal and ground terminals), the connector does not become large in the longitudinal direction (a direction of pitch or arrangement of the contacts) of the connector, thus making the mount area small. Also, since the interval between the contact portions of the signal and ground terminals can be designed large, the crimp-style cable connector is applicable as a mating connector.

According to still another aspect of the invention, the first contact terminal comprises a first press-fit fixing portion, a first contact portion extending from an end of the first press-fit fixing portion and having a first contact at a curved point thereof, and a first lead portion extending from the other end of the first press-fit fixing portion and bent at substantially right angles with respect to the first press-fit fixing portion on the same side as the first contact, and the second contact terminal comprises a second press-fit fixing portion, a second contact portion extending from an end of the second press-fit fixing portion and having a second contact at a curved point thereof, and a second lead portion extending from the other end of the second press-fit fixing portion and bent at substantially right angles with respect to the second press-fit fixing portion on the side opposite to a side of the second contact, wherein the first and second contact terminals have the same length of transmission path.

In the differential signal transmission of high speed signal, signals having opposite phases from each other are transmitted in a pair of signal transmission lines to take the difference between the phases of the two signals, thereby to strengthen the resistance to noise from the outside. The defective point of the differential signal transmission is that when common mode components are superimposed or overlapped with each other, the electromagnetic radiation noise is increased. One of reasons of generation of the common mode components is that the distal ends of the pair of the lines are inconsistent. An example of the inconsistency is a mismatching length of the pair of the lines. In the present invention, since the contact terminals have the same length of the transmission lines, it is possible to eliminate the inconsistency of the mismatching length.

According to yet another aspect of the invention, the mating connector further comprises a plug-in hollow provided in a front face of the mating insulation case, and a first wall and a second wall standing at sides in the non-longitudinal direction of the connector such that the first and second walls sandwich the plug-in hollow, wherein a plurality of the first mating terminal fit portions provided in the first wall at predetermined intervals in the longitudinal direction of the mating connector and opened to the plug-in hollow, and a plurality of second terminal fit portions provided in the second wall at the predetermined intervals in the longitudinal direction of the mating connector and opened to the plug-in hollow, wherein the first mating contact terminals are fitted in the first mating terminal fit portions and having first contact portions exposed to the plug-in hollow, and the second mating contact terminals are fitted in the second mating terminal fit portions and having second contact portions exposed to the plug-in hollow, wherein the first and second mating contact terminals have the same length of transmission path.

By the above construction, since the interval between the contact portions of the contact terminals (signal and ground terminals) can be designed large, the crimp-style connector becomes applicable as a mating connector of the connector.

According to an aspect of the invention, a pair of the first and second mating contact terminals constitutes a mating signal terminal and another pair of the first and second mating contact terminals constitutes a mating ground terminal, and the mating signal and ground terminals are alternately provided in the longitudinal direction of the mating connector. By the above construction, since the interval between the contact portions of the signal and ground terminals can be designed large, the crimp-style connector becomes applicable as a mating connector of the connector.

According to another aspect of the invention, each of the first and second mating contact terminals is a crimp-style and comprises a crimp portion connecting the each of the first and second mating contact terminals to an end portion of a cable by a crimp, a fixed portion extending from the crimp portion, and a contact section extending from the fixed portion and brought into contact with each of the first and second contacts of the first and second contact terminals, wherein each of the first and second mating terminal fit portions comprises a terminal insertion portion and a contact insertion portion provided in the first or second wall along a direction of inserting of the mating connector, and wherein the contact section is inserted into the contact insertion portion and the fixed portion is fixed to the terminal insertion portion, thereby to fit the first and second mating contact terminals in the first and second mating terminal fit portions, respectively.

By the above construction, since the first and second contact terminals employ a crimp-style, which connects the end portions of the cable by a crimp, the first and second contact terminals are easily inserted into the first and second terminal fit portions.

According to still another aspect of the invention, the contact insertion portion comprises a guide portion and a pair of projection insertion holes in a closed top side thereof, and the contact section has a sectional shape of ⊐and comprises a guide groove thereinside and a pair of projections on a top side thereof, and wherein when the first and second mating contact terminals are fitted in the first and second terminal fit portions, the guide portion is inserted into the guide groove and the projections are inserted into the projection insertion holes.

Since the contact section has a sectional shape of ⊐to increase the strength so that when the contact section is inserted into the contact insertion portion, buckling and deformation are prevented and the working efficiency of harness is increased. Also, when the contact terminals are fitted in the mating terminal fit portions, since the guide portion is inserted into the guide groove, the contact section is easily inserted into the contact insertion portion. Further, when the mating connector is connected to the connector, since the projections are inserted into the projection insertion holes, buckling and deformation caused by fall of the mating connector is prevented.

According to yet another aspect of the invention, the fixed portion and contact section are made by bending a sheet metal and the fixed portion has a closed sectional shape of a quadrilateral frame. By the above construction, the strength of the first and second contact terminals is increased and when the contact section is inserted into the contact insertion portion, buckling and deformation are prevented and the working efficiency of the harness is increased.

According to an aspect of the invention, the connector plug-in section of the connector has a shield plate therein and the mating connector pug-in section of the mating connector is covered by a shield shell having ground terminal contact portions, which are inserted into the first and second mating terminal fit portions to be brought into contact with the mating ground terminal. By the above construction, the mating ground terminals are easily brought into contact with the shield shell only by inserting the mating ground terminals into the first and second mating terminal fit portions.

According to another aspect of the invention, a different type of multi way connector comprises a connector and a mating connector, wherein the connector includes an insulation case, a connector plug-in section provided in the insulation case, a plug-in protrusion provided in a front face of the insulation case, two rows of plug-in spaces provided in a longitudinal direction of the connector and sandwiching the plug-in protrusion, a plurality of first contact terminals formed integrally by insertion molding in the plug-in protrusion and exposed to one row of the plug-in spaces, each of the first contact terminals having a lead portion, and a plurality of second contact terminals formed integrally by insertion molding in the plug-in protrusion and exposed to the other row of the plug-in spaces, each of the second contact terminals having a lead portion, wherein the first and second contact terminals have the same length of transmission path and are alternately provided at predetermined intervals in the longitudinal direction of the connector, and the first and second lead portions extend in the same side in a non-longitudinal direction of the connector. The mating connector includes a mating insulation case, a mating connector plug-in section provided in the mating insulation case, a plurality of first mating contact terminals provided in the mating connector plug-in section, and a plurality of second mating contact terminals provided in the mating connector plug-in section, wherein the mating connector plug-in section is plugged in the connector plug-in section so that the contact terminals are brought into contact with the mating contact terminals for conduction.

By the above construction, even if the connector is multi way type, since the interval between the lead portions (mounted portions) are made a half of the interval between the contact portions of the contact terminals (signal and ground terminals), the connector does not become large in the longitudinal direction (a direction of pitch or arrangement of the contacts) of the connector, thus making the mount area small. Also, since the interval between the contact portions of the signal and ground terminals can be designed large, the crimp-style cable connector is applicable as a mating connector.

Further, since the thickness in a widthwise direction (non-longitudinal direction of the connector) of the connector can be designed large to increase the strength of the connector so that the working efficiency upon insertion and removal of the mating connector is increased, a mating connector of a board mount type is applicable, and the connection method is diversified including a vertical mount. Even if the thickness of the connector becomes large, the size of the connector represented by the width×the length (a dimension of the non-longitudinal direction×a dimension of the longitudinal direction) of the connector is made relatively small with respect to the conventional connector.

According to the present invention, even if the connector is multi way type, since the interval between the lead portions (mounted portions) are made a half of the interval between the contact portions of the contact terminals (signal and ground terminals), the connector does not become large in the longitudinal direction (a direction of pitch or arrangement of the contacts) of the connector, thus making the mount area small. Also, since the interval between the contact portions of the signal and ground terminals can be designed large, the crimp-style cable connector is applicable as a mating connector.

In the differential signal transmission of high speed signal, signals having opposite phases from each other are transmitted in a pair of signal transmission lines to take the difference between the phases of the two signals, thereby to strengthen the resistance to noise from the outside. The defective point of the differential signal transmission is that when common mode components are superimposed or overlapped with each other, the electromagnetic radiation noise is increased. One of reasons of generation of the common mode components is that the distal ends of the pair of the lines are inconsistent. An example of the inconsistency is a mismatching length of the pair of the lines. In the present invention, since the contact terminals have the same length of the transmission lines, it is possible to eliminate the inconsistency of the mismatching length.

According to the present invention, since the interval between the contact portions of the contact terminals (signal and ground terminals) can be designed large, the crimp-style connector becomes applicable as a mating connector of the connector. By the above construction, since the first and second contact terminals employ a crimp-style, which connects the end portions of the cable by a crimp, the first and second contact terminals are easily inserted into the first and second terminal fit portions.

According to the present invention, since the contact section has a sectional shape of ⊐to increase the strength so that when the contact section is inserted into the contact insertion portion, buckling and deformation are prevented and the working efficiency of harness is increased. Also, when the contact terminals are fitted in the mating terminal fit portions, since the guide portion is inserted into the guide groove, the contact section is easily inserted into the contact insertion portion. Further, when the mating connector is connected to the connector, since the projections are inserted into the projection insertion holes, buckling and deformation caused by fall of the mating connector is prevented.

According to the present invention, the mating ground terminals are easily brought into contact with the shield shell only by inserting the mating ground terminals into the first and second mating terminal fit portions.

DESCRIPTION OF THE PREFERRED EMBODIMENTS

Embodiments of the present invention will now be described with reference to the accompanying drawings. A multi way connector according to the present invention is composed of a receptacle connector A as a main connector and a cable connector B as a mating connector. The receptacle connector A is mounted on the back of an LCD pane and so forth and united or connected to the cable connector B connected to a wiring or a transmission line of an equipment body to transmit an electric signal from the body to the LCD panel.

Figure 4:
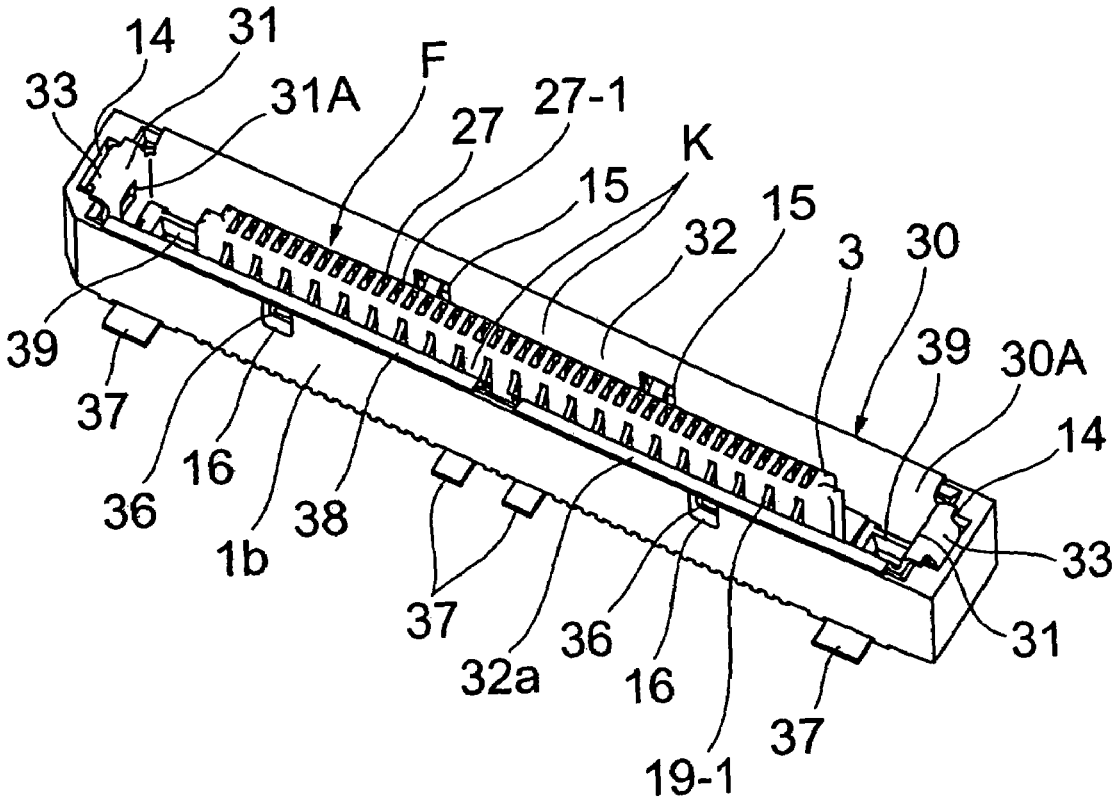
FIG. 4 is a perspective view of the receptacle connector.
Figure 5:
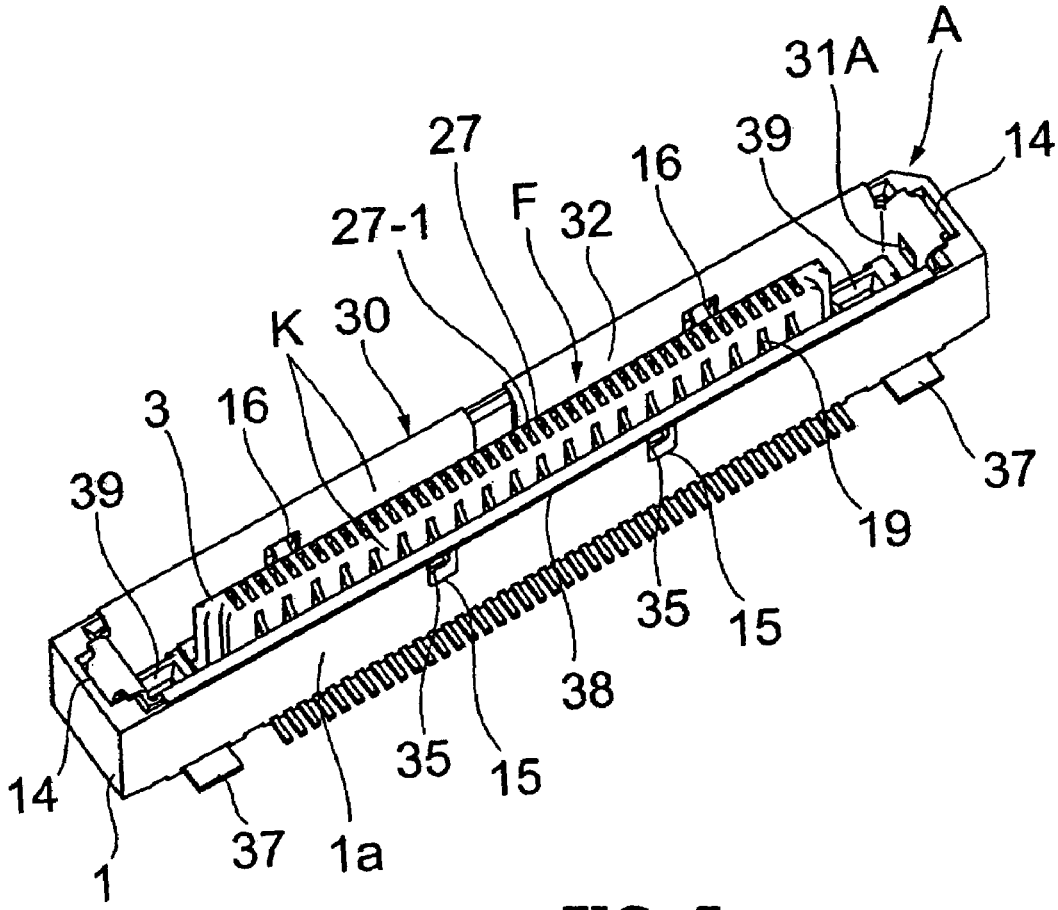
FIG. 5 is a perspective view of the receptacle connector of FIG. 4 as seen from the opposite side.
Figure 10:
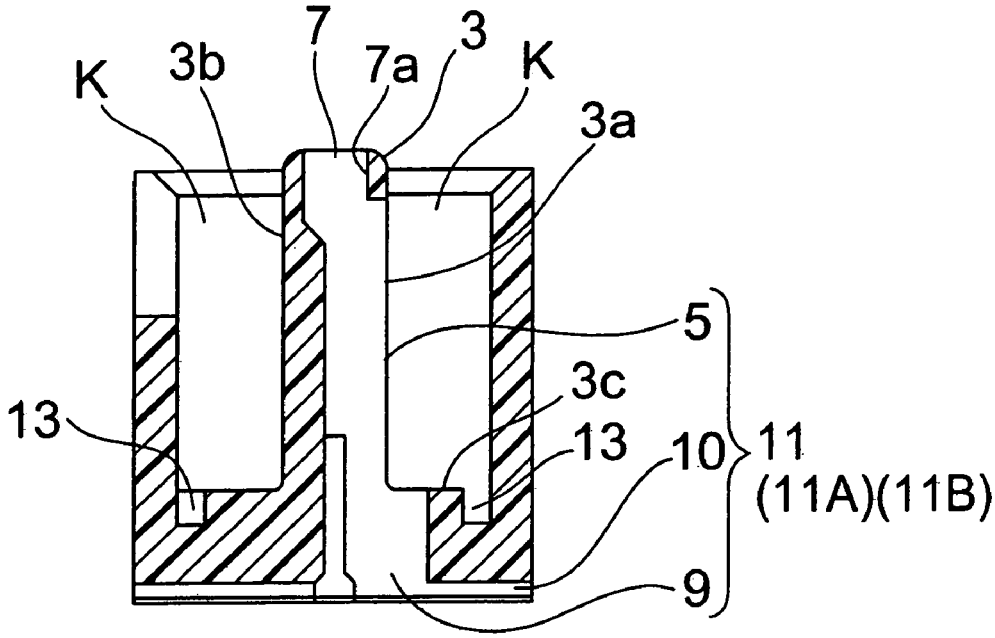
FIG. 10 is a cross-sectional view of the insulation case taken along the line C—C of FIG. 9.
Figure 11:
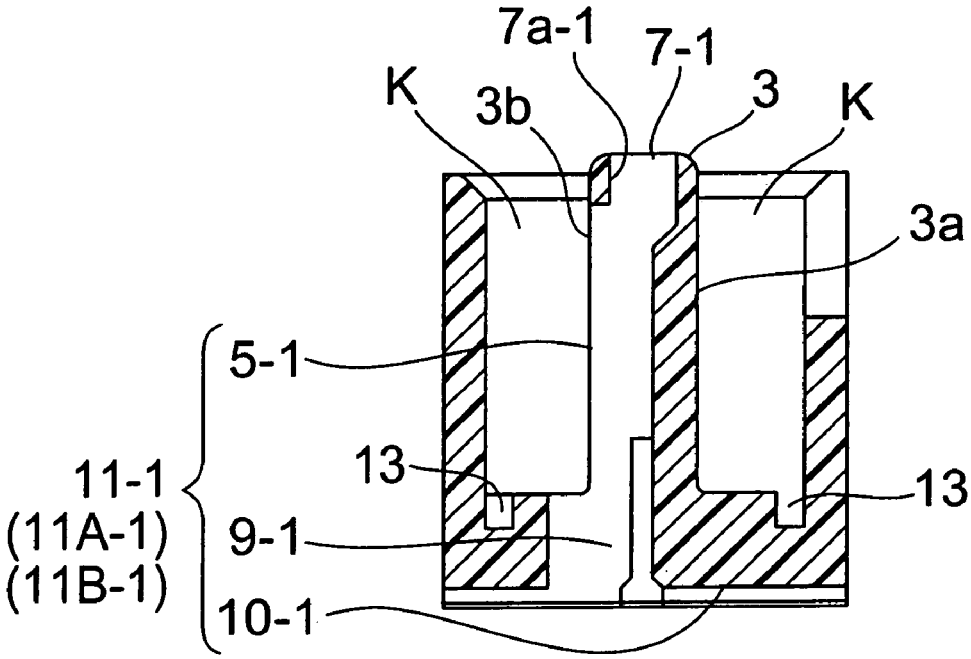
FIG. 11 is a cross-sectional view of the insulation case taken along the line D—D of FIG. 9.

In FIGS. 4 and 5, the receptacle connector A comprises an insulation case 1, a plurality of contact terminals 19, and 19-1 provided in a connector plug-in section F of the insulation case 1, and a shield plate 30. The connector plug-in section F is provided in the front side of the insulation case 1 and comprises a plugging protrusion 3, two rows of plug-in spaces K provided on both sides of the plugging protrusion 3 in the longitudinal direction of the connector, and a shield plate 30 provided in the fitting protrusion K. In FIG. 10, a plurality of terminal fit-in grooves 5 are provided on a side face 3*a* of the plugging protrusion 3 at predetermined intervals in the longitudinal direction of the connector. In FIG. 11, a plurality of terminal fit-in grooves 5-1 are provided on the other side face 3*b* of the plugging protrusion 3 at predetermined intervals in the longitudinal direction of the connector. The terminal fit-in grooves 5 and 5-1 are provided alternately at predetermined intervals in the longitudinal direction of the connector.

As shown in FIGS. 10 and 11, a terminal insertion hole 7 is provided on the top of the terminal fit-in groove 5 and opened the top face of the plugging protrusion 3. A terminal insertion hole 7-1 is provided on the top of the terminal fit-in groove 5-1 and opened the top face of the plugging protrusion 3. The terminal insertion holes 7 and 7-1 are provided alternately at predetermined intervals in the longitudinal direction of the connector. Also, as shown in FIGS. 10 and 11, terminal press-fit holes 9 and 9-1 are provided on the rear face of the insulation case 1 and communicated to the terminal fit-in grooves 5 and 5-1, respectively. Terminal lead insertion grooves 10 and 10-1 are also provided on the rear face of the insulation case 1 and communicated to the terminal press-fit holes 9 and 9-1, respectively. The terminal lead insertion holes 10 and 10-1 are provided alternately at predetermined intervals in the longitudinal direction of the connector.

A set of the terminal lead insertion groove 10, the terminal press-fit hole 9, and the terminal fit-in groove 5 form a terminal fit portion 11. A set of the terminal lead insertion groove 10-1, the terminal press-fit hole 9-1, and the terminal fit-in groove 5-1 form another terminal fit portion 11-1. Each of the terminal fit portions 11 includes a signal terminal fit portion 11A and a ground terminal fit portion 11B, which are provided alternately. Each of the terminal fit portions 11-1 includes a signal terminal fit portion 11A-1 and a ground terminal fit portion 11B-1, which are provided alternately.

Figure 9:
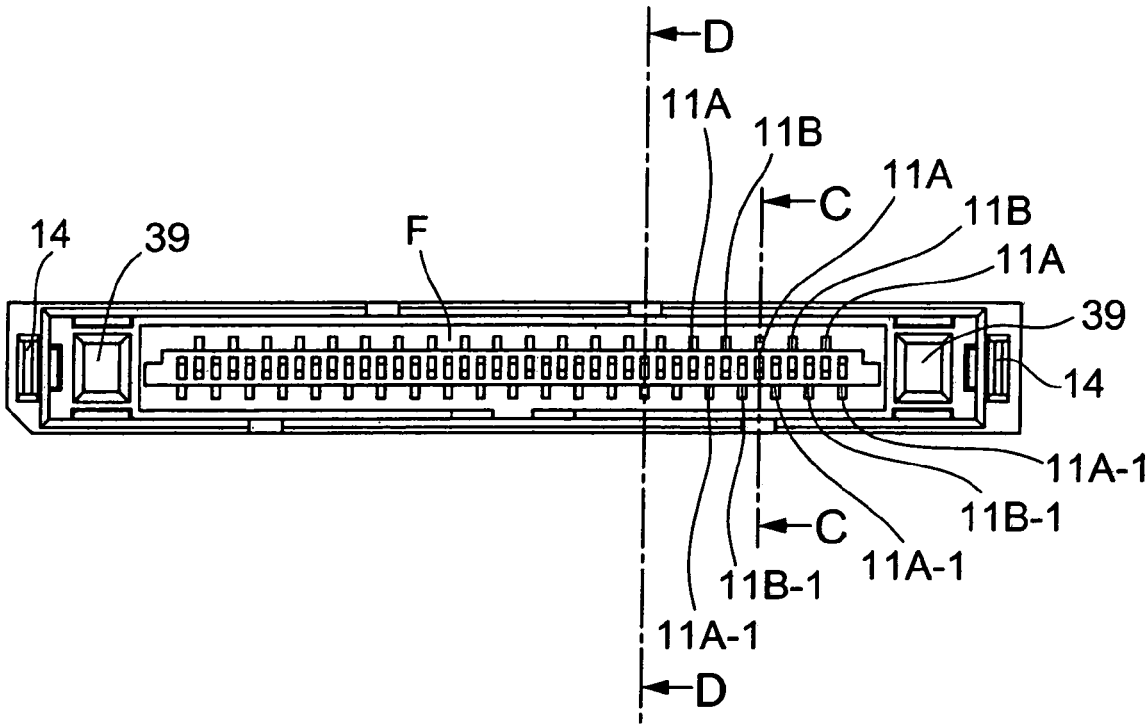
FIG. 9 is a top view of an insulation case of the receptacle connector of FIG. 4.

In FIG. 10, shield insertion grooves 13 are provided on the bottom of the plug-in spaces K along the longitudinal direction of the connector. In FIG. 9, a pair of shield engagement portions 14 is provided on both distal end sides of the connector plug-in section F in the longitudinal direction of the connector. As shown in FIGS. 4 and 5, a pair of engagement cut-off portions 15 is provided in a side wall 1*a* of the insulation case 1. A pair of engagement cut-off portions 16 is provided in the other side wall 1*b* of the insulation case 1. Guide holes are provided at both ends of the connector plug-in section F in the longitudinal direction of the connector.

Figure 12:
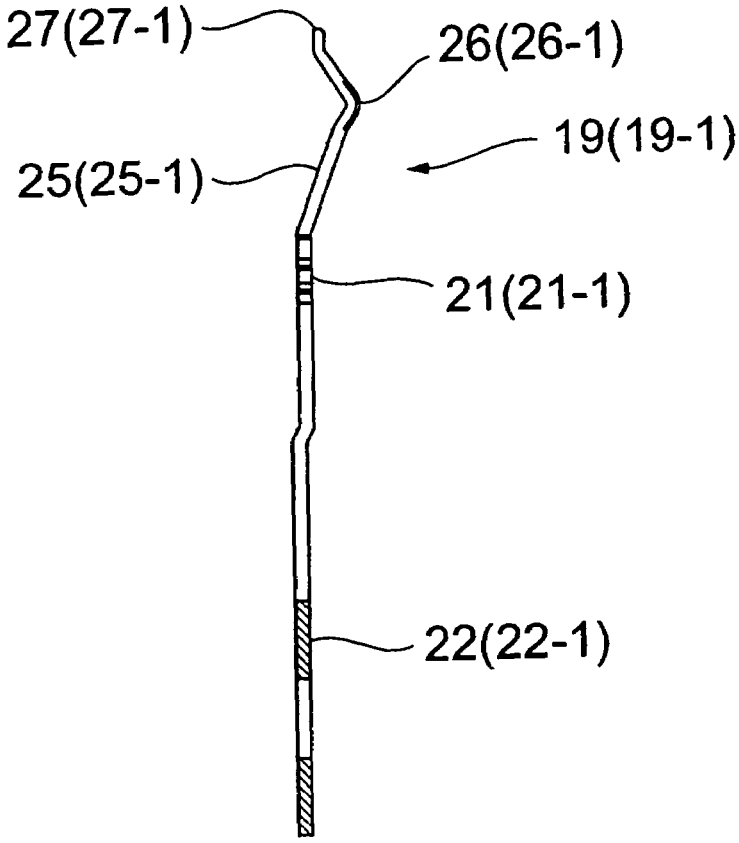
FIG. 12 is a side view of a contact terminal.
Figure 13:
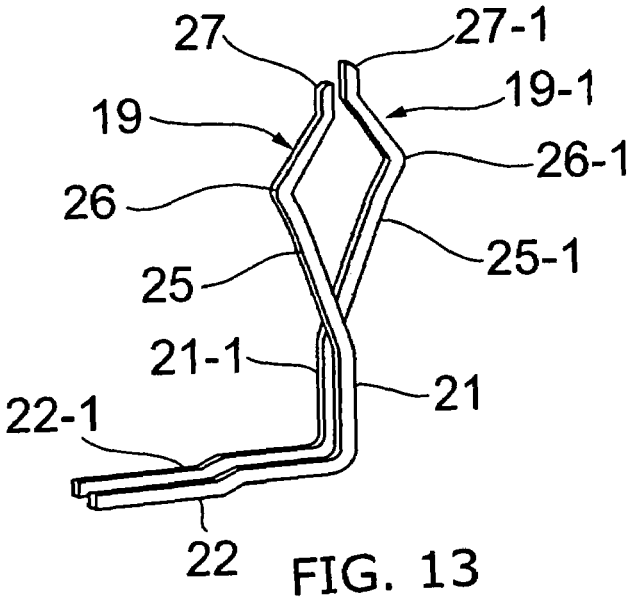
FIG. 13 is a perspective view of a pair of the contact terminals, wherein the pair constitutes the signal terminal for differential transmission signal.

In FIGS. 12 and 13, the contact terminal 19 comprises a press-fit fixing portion 21, a lead portion 22 bent from an end of the press-fit fixing portion 21, and a contact portion 25 extending from the other end of the press-fit portion 21 and slightly bent on the side of the lead portion 22. The contact portion 25 comprises a contact 26 at a curved point thereof and an insertion portion 27 at a distal end thereof, which extends substantially in parallel to the press-fit fixing portion 21. The lead portion 22 is bent to the side of the contact 26 at substantially right angles with respect to the press-fit fixing portion 21.

In FIGS. 12 and 13, the contact terminal 19-1 comprises a press-fit fixing portion 21-1, a lead portion 22-1 bent from an end of the press-fit fixing portion 21-1, and a contact portion 25-1 extending from the other end of the press-fit portion 21-1 and slightly bent on the opposite side of the lead portion 22-1. The contact portion 25-1 and the contact portion 25 are bent in the opposite directions. The contact portion 25-1 comprises a contact 26-1 at a curved point thereof and an insertion portion 27-1 at a distal end thereof, which extends substantially in parallel to the press-fit fixing portion 21-1. The lead portion 22-1 is bent on the side opposite to the side of the contact 26-1 at substantially right angles with respect to the press-fit fixing portion 21-1. The respective portions of the contact terminal 19 have the same dimensions as those of the contact terminal 19-1. That is, the press-fit fixing portions 21 and 21-1 have the same dimension, the lead portions 22 and 22-1 have the same dimension, the insertion portions 27 and 27-1 have the same dimension.

Figure 7:
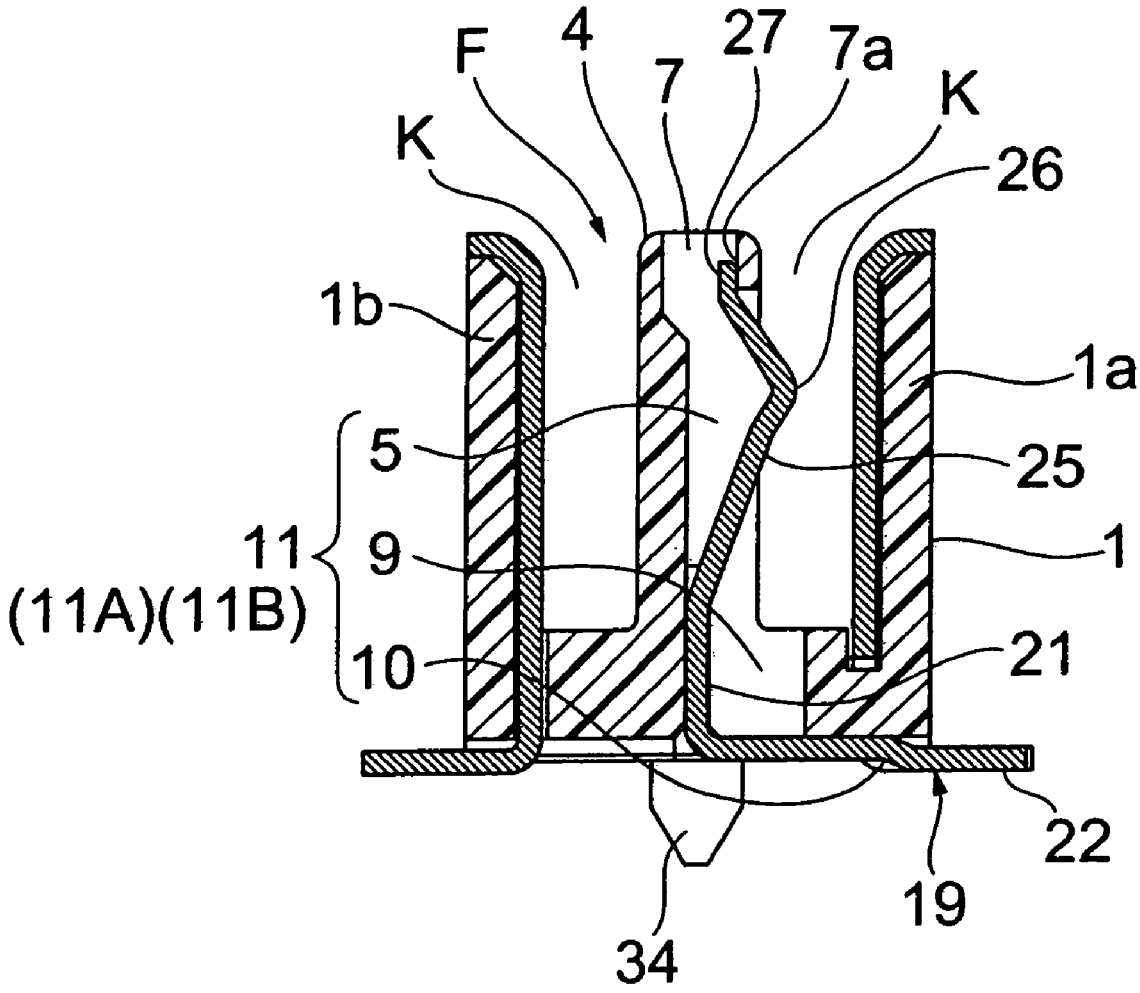
FIG. 7 is a cross-sectional view of the receptacle connector of FIG. 4.

In FIG. 7, the contact terminal 19 is mounted or fitted in the signal and ground terminal fit portions 11A and 11B. That is, the press-fit fixing portion 21 is press-fitted in the terminal press-fit hole 9, the lead portion 22 is inserted into the terminal lead insertion groove 10, the contact portion 25 is inserted into the terminal fit-in groove 5, the insertion portion 27 is inserted into the terminal insertion hole 7, the contact 26 of the contact portion 25 projects into one of the plug-in spaces K of the connector plug-in section F. The insertion portion 27 abuts against an outer face 7*a* of the terminal insertion hole 7.

Figure 8:
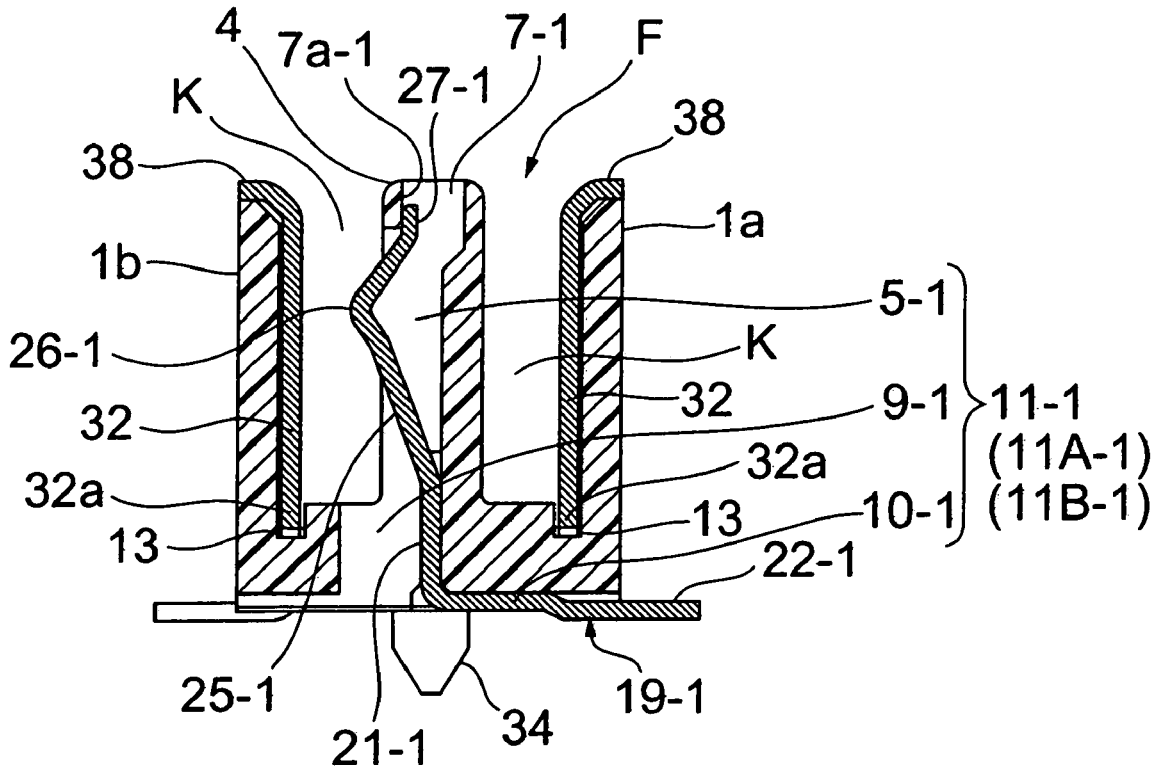
FIG. 8 is a cross-sectional view of the receptacle connector of FIG. 4 taken along another part.

In FIG. 8, the contact terminal 19-1 is mounted or fitted in the signal and ground terminal fit portions 11A-1 and 11B-1. That is, the press-fit fixing portion 21-1 is press-fitted in the terminal press-fit hole 9-1, the lead portion 22-1 is inserted into the terminal lead insertion groove 10-1, the contact portion 25-1 is inserted into the terminal fit-in groove 5-1, the insertion portion 27-1 is inserted into the terminal insertion hole 7-1, the contact 26-1 of the contact portion 25-1 projects into the other of the plug-in spaces K of the connector plug-in section F. The insertion portion 27-1 abuts against an outer face 7*a*-1 of the terminal insertion hole 7-1. The two contact terminals 19 and 19-1 fitted in the signal terminal fit portions 11A and 11A-1 make a pair of signal terminals for the differential transmission. The two contact terminals 19 and 19-1 fitted in the ground terminal fit portions 11B and 11B-1 make a pair of ground terminals for the differential transmission.

Figure 6:
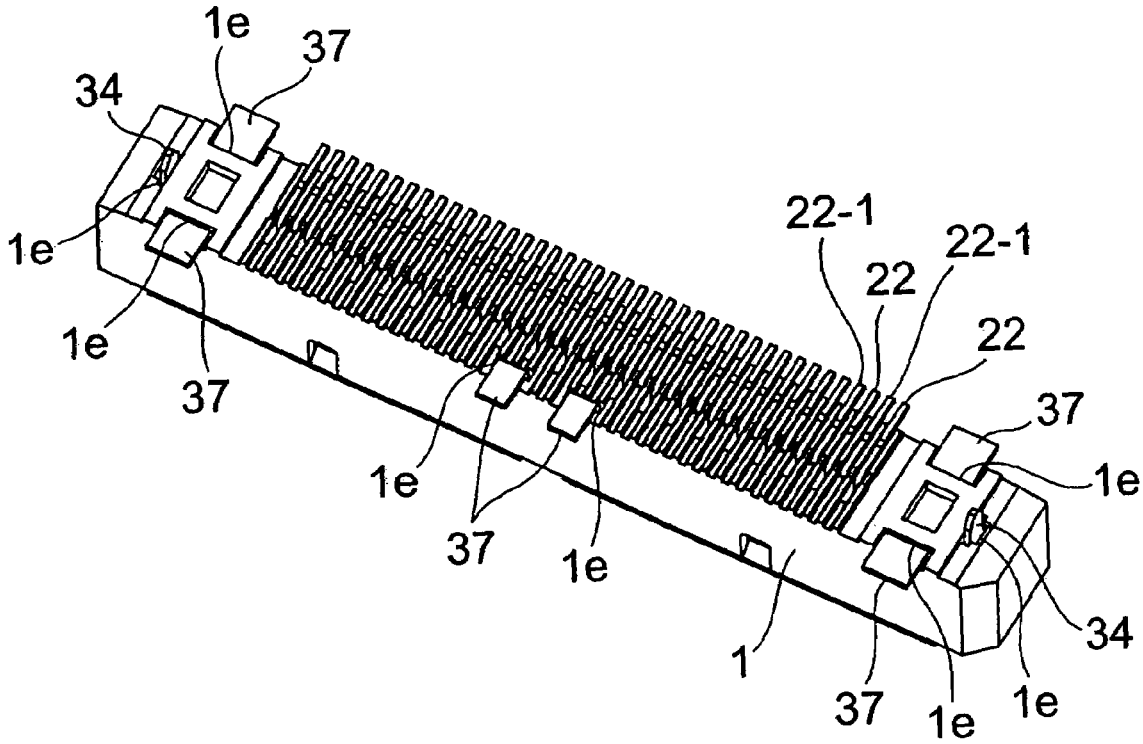
FIG. 6 is a perspective view of the receptacle connector of FIG. 4 as seen from the back side.
Figure 14:
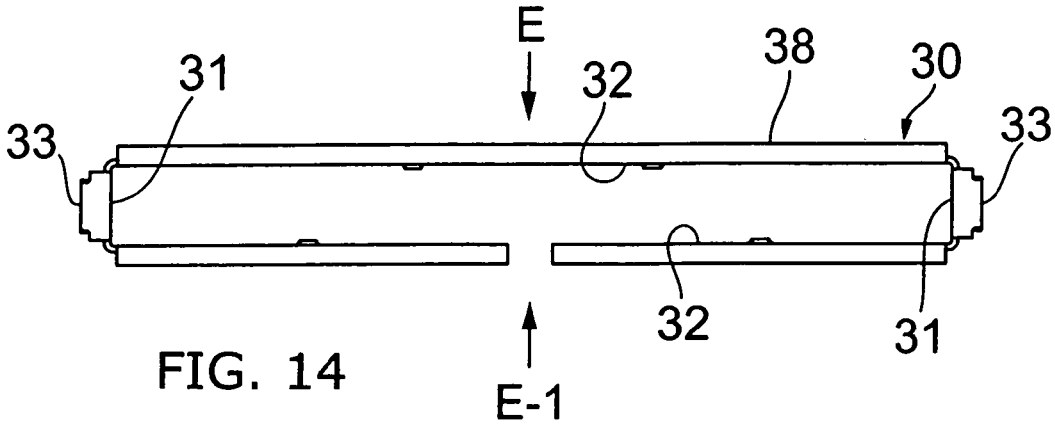
FIG. 14 is a top view of a ground plate.
Figure 15:
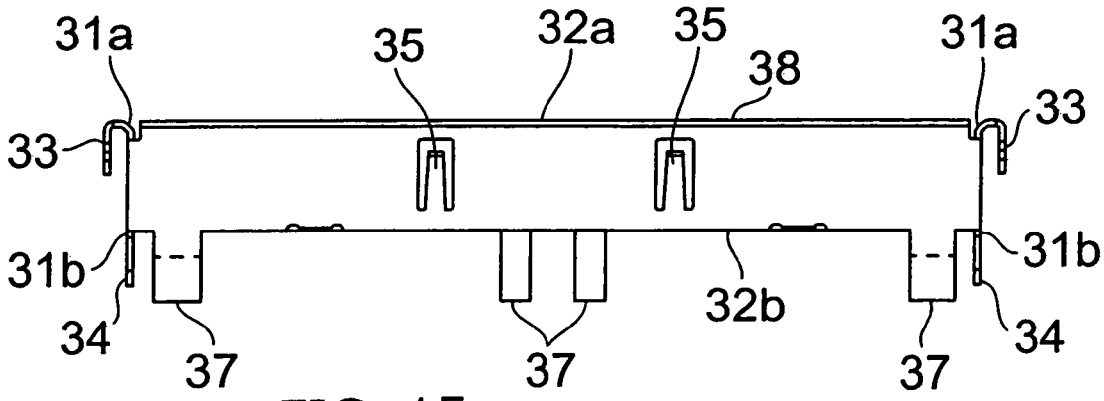
FIG. 15 is a side view of the ground plate seen from the arrow E of FIG. 14.
Figure 16:
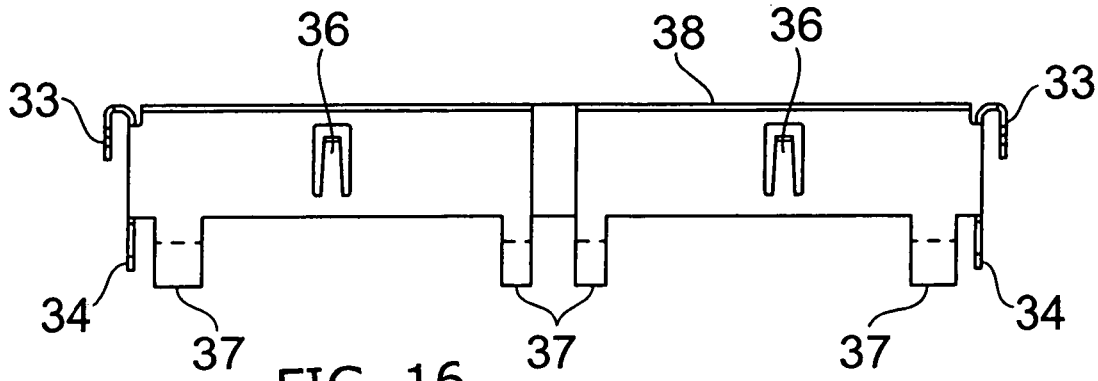
FIG. 16 is a side view of the ground plate seen from the arrow E-1 of FIG. 14.

In FIGS. 14–16, the shield plate 30 is formed by bending a sheet metal in a shape of rectangular frame and comprises two end shield portions 31 facing to each other and two side shield portions 32 facing to each other. As shown in FIGS. 4–6, a lock hole 31A is provided in the end shield portion 31. A pair of bent engagement portions 33 is provided at a periphery 31*a* of the end shield portions 31 in the height direction of the connector and a pair of engagement portions 34 is provided at the other periphery 31*b*. A periphery 32*a* of the side shield portions 32 is curved. Shield lead portions 37 are provided at the other periphery 32*b* of the side shield portions 32. Further, a pair of engagement pieces 35 is provided in one of the side shield portions 32 and a pair of engagement pieces 36 is provided in the other of the side shield portions 32.

As shown in FIGS. 4 and 5, the shield plate 30 is installed in the plug-in spaces K of the insulation case 1 such that the periphery 32*a* of the side shield portions 32 is placed along the side walls 1*a* and 1*b*. The bent engagement portions 33 engage with the shield engagement portions. As shown in FIGS. 7 and 8, the other periphery 32*b* is inserted into the shield insertion grooves 13. Also, as shown in FIGS. 4 and 5, the engagement pieces 35 and 36 engage with the engagement cut-offs 15 and 16, respectively. In FIG. 6, the engagement portions 34 and the shield lead portions 37 project from holes 1*e* provided in the insulation case 1 into the outside of the plug-in spaces K.

The engagement portions 34 projecting from the bottom of the insulation case 1 of the receptacle connector A are inserted into engagement holes provided in a printed circuit board (not shown in the drawings). The respective lead portions 22 and 22-1 of the signal and ground terminals formed by the respective contact terminals 19 and 19-1 are brought into contact with soldering cream provided on ground pattern (not shown) of the printed circuit board and soldered to contact pattern portions by reflow. The respective shield lead portions 37 of the shield plate 30 are also soldered in the same way.

In FIGS. 17–25, the cable connector B as a mating connector comprises a crimp-style case 51 (an insulation case 51), a plurality of contact terminals 70 provided in a connector plug-in section F-1, and a shield shell, or shield members 81 and 82.

Figure 20:
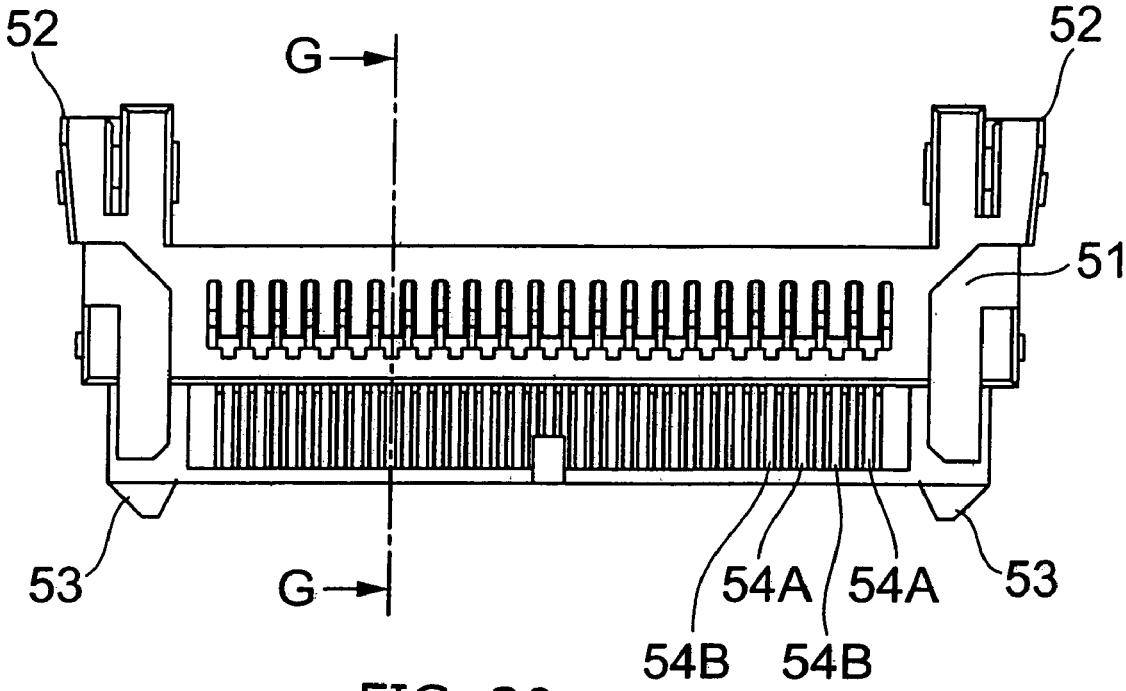
FIG. 20 is a side view of an insulation case of the cable connector.
Figure 21:
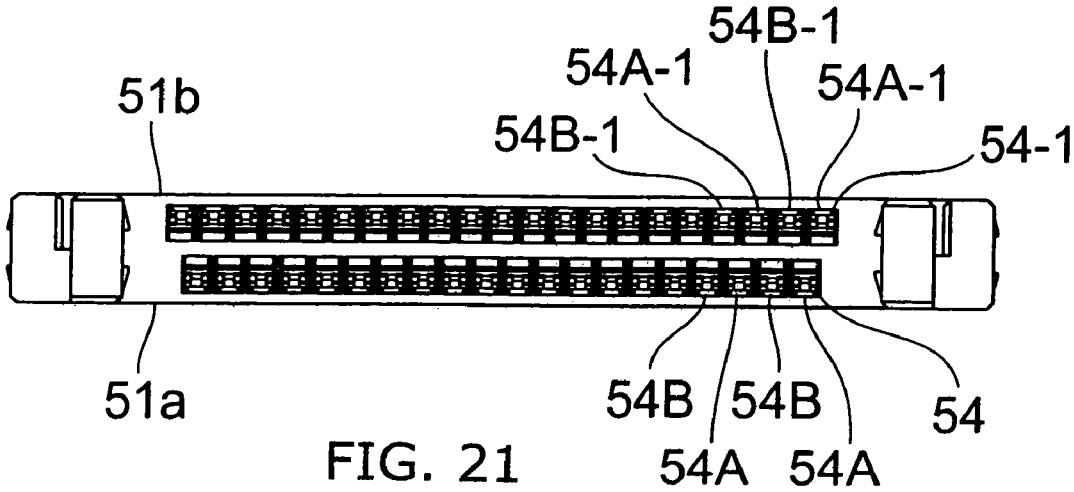
FIG. 21 is a top view of the insulation case of FIG. 20.
Figure 22:
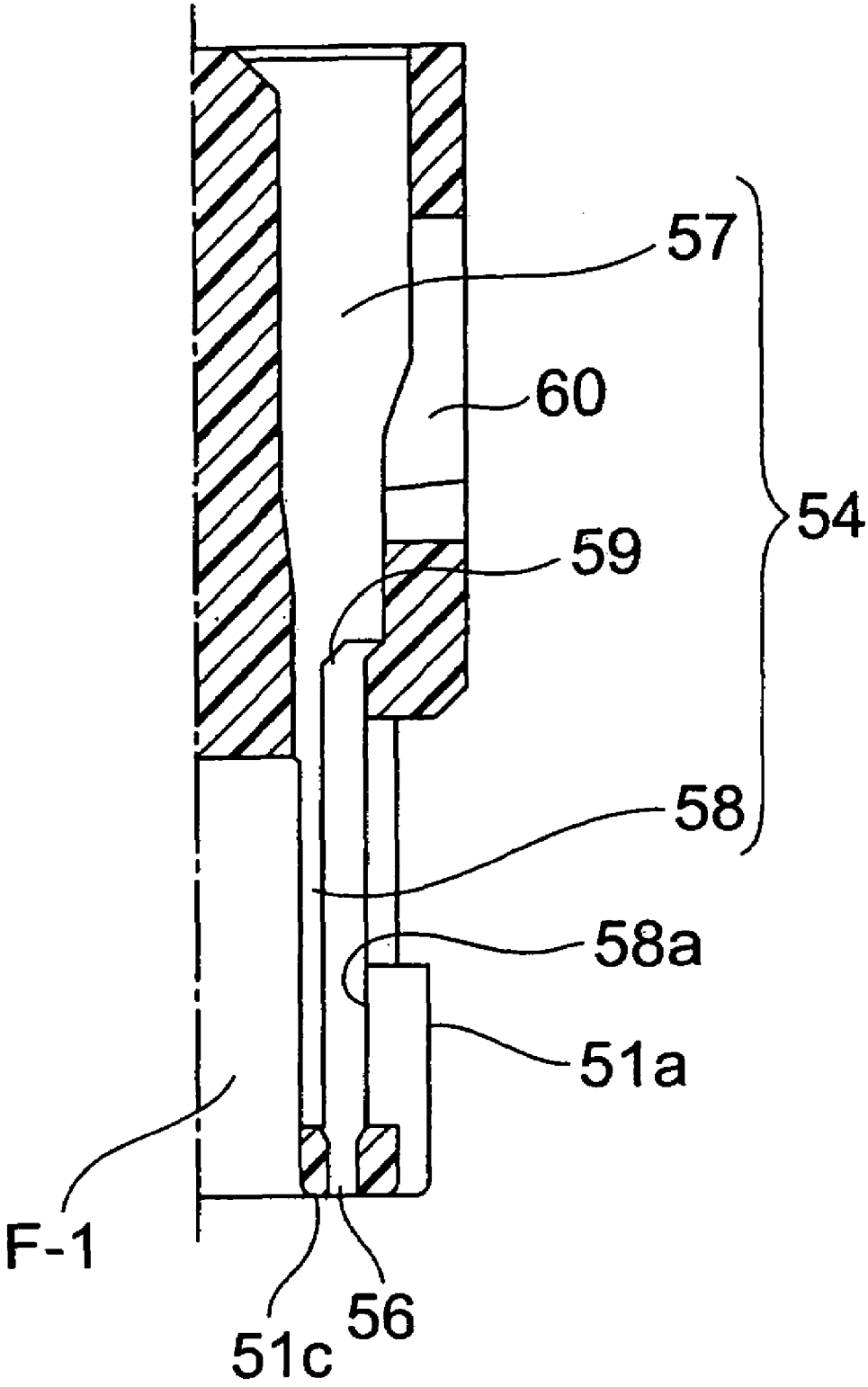
FIG. 22 is a cross-sectional view, partly omitted, of the insulation case taken along the line G—G.

As shown in FIGS. 20–22, holding portions 52 are provided at ends of the crimp-style case 51 in the longitudinal direction of the connector. Guide posts 53 are provided on the opposite sides of the holding portions 52.

Figure 19:
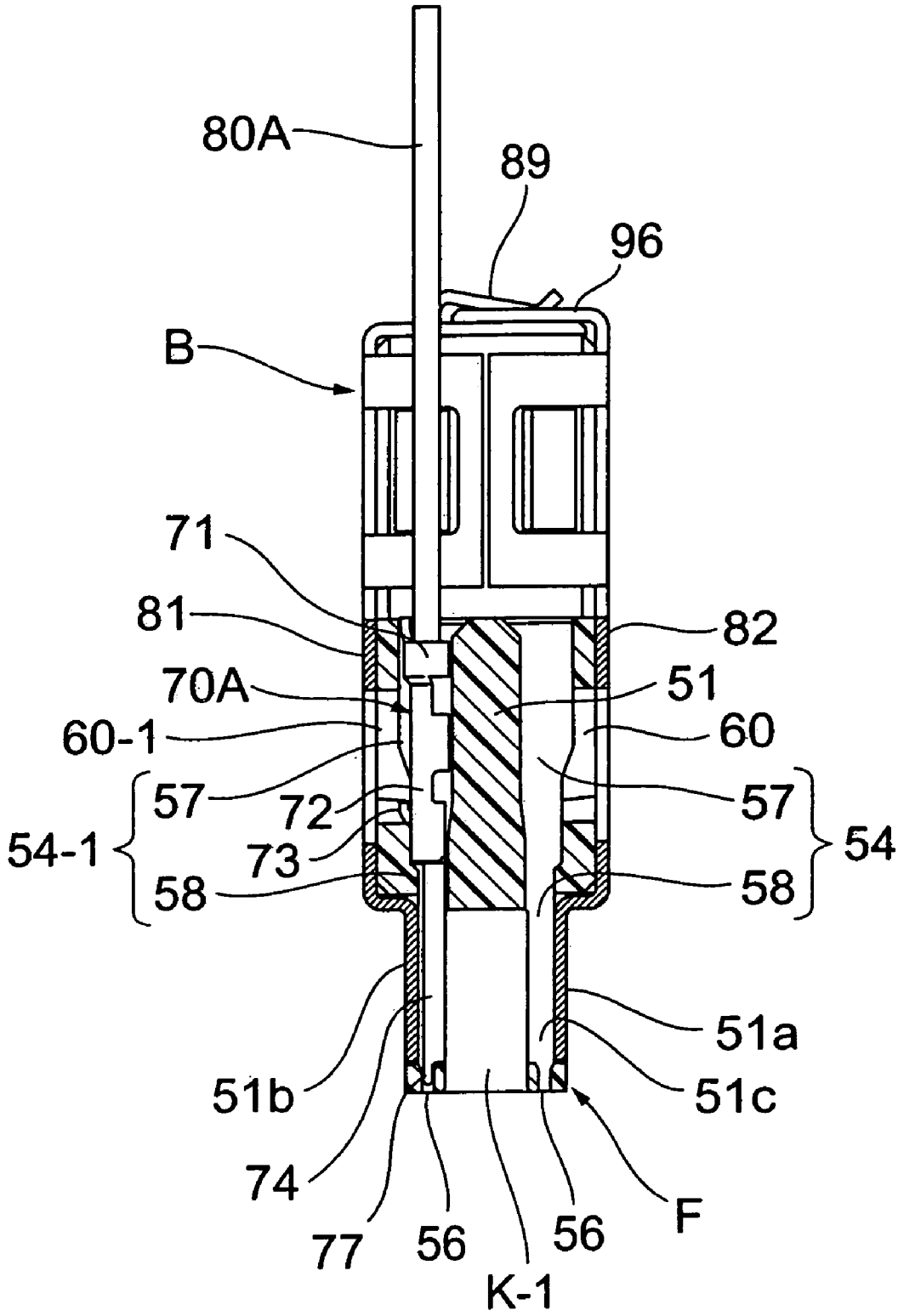
FIG. 19 is a cross-sectional view of the cable connector.

As shown in FIG. 19, the crimp-style case 51 comprises, at the front side thereof, a plug-in hollow K-1 and a connector plug-in section F-1 having two walls 51*a* and 51*b*, which stand at sides in a non-longitudinal direction of the connector sandwiching the plug-in hollow K-1. A plurality of terminal fit portions 54 are provided in the wall 51*a* at predetermined intervals in the longitudinal direction of the connector and a plurality of terminal fit portions 54-1 are provided in the wall 51*b* at intervals shifting from the predetermined intervals of the terminal fit portions 54 by a half pitch. The terminal fit portions 54 and 54-1 are closed at a top face 51*c* of the crimp-style case 51. A pair of projecting insertion holes 56 is provided in the top face 51*c*, corresponding to the terminal fit portions 54 and 54-1. Each of the terminal fit portions 54 and 54-1 has a terminal insertion portion 57 and a contact insertion portion 58. In FIG. 22, a guide portion 59 is provided on a side face 58*a* of the contact insertion portion 58.

As shown in FIG. 21, the terminal fit portions 54 are composed of a plurality of signal terminal fit portions 54A and a plurality of ground terminal fit portions 54B, which are arranged alternately. The terminal fit portions 54-1 are composed of a plurality of signal terminal fit portions 54A-1 and a plurality of ground terminal fit portions 54B-1, which are arranged alternately.

As shown in FIGS. 19 and 20, a plurality of opening portions 60 are provided in a side face of the crimp-style case 51 in the longitudinal direction of the connector, which are opened to the terminal insertion portion 57 of the ground terminal fit portion 54B. A plurality of opening portions 60-1 are provided in the other side face of the crimp-style case 51 in the longitudinal direction of the connector, which are opened to the terminal insertion portion 57 of the ground terminal fit portion 54B-1.

Figure 23:
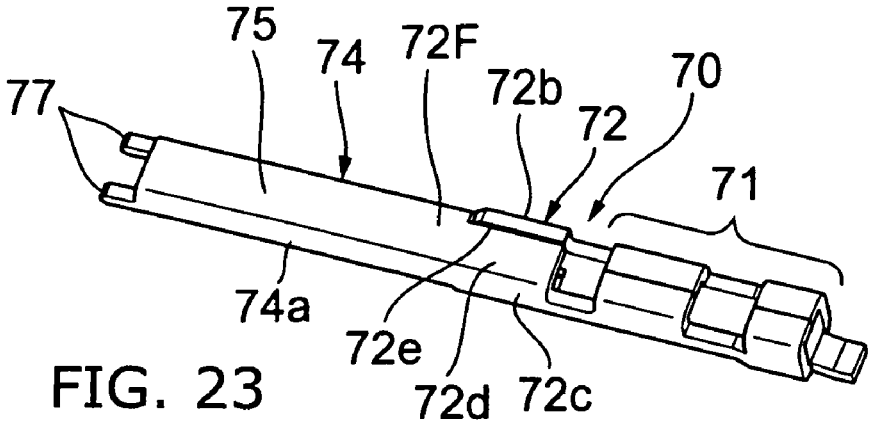
FIG. 23 is a perspective view of a crimp terminal seen from a front side.
Figure 24:
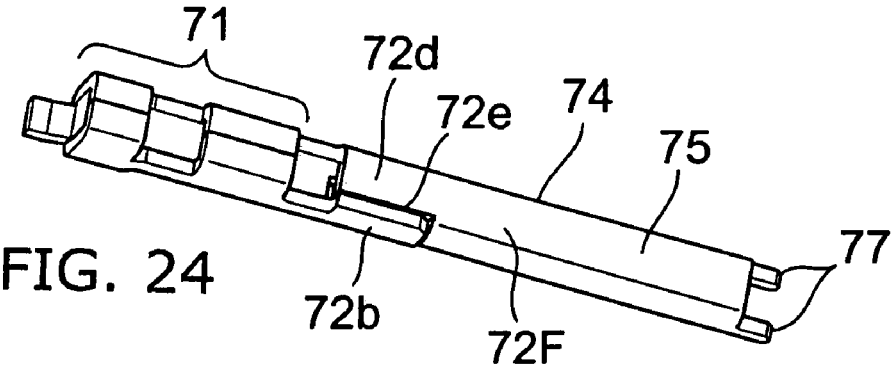
FIG. 24 is a perspective view of the crimp terminal of FIG. 23 seen from another front side.
Figure 25:
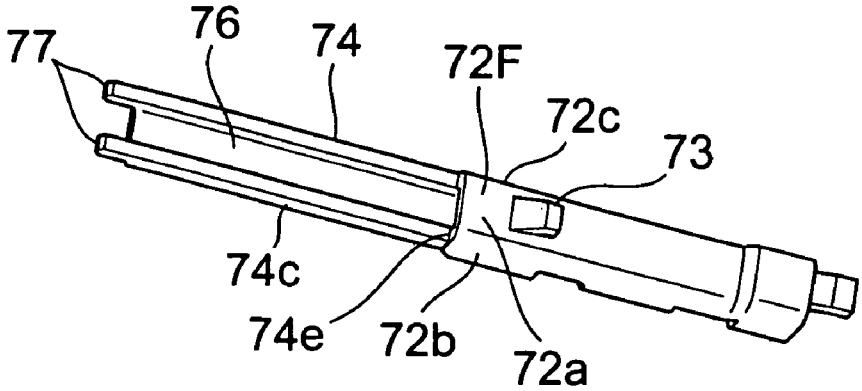
FIG. 25 is a perspective view of the crimp terminal of FIG. 23 seen from a back side.

As shown in FIGS. 23-25, the contact terminal 70 is crimp-style terminal and comprises a crimp portion 71, a fixed portion 72, and a contact section 74. The fixed portion 72 has a closed sectional shape of a quadrilateral and is provided with an engagement projection 73 in a face 72*a* thereof. The contact section 74 has a sectional shape of ⊐. The top face of the contact section 74 is used as a contact portion 75. The contact section 74 has a guide groove 76 in the inside thereof and a pair of projections 77 at the top thereof. The fixed and contact portions 72 and 74 are made by bending a sheet metal. Namely, to make the fixed portion 72, a sheet metal material 72F is bent at right angles with respect to a top face 72*a* to form side faces 72*b* and 72*c*. Further, the sheet metal material 72F is bent at right angles with respect to the side face 72*c* to form a back face 72*d* opposing to the top face 72*a* such that a periphery 72*e* of the back face 72*d* abuts against the side face 72*b*.

Figure 2:
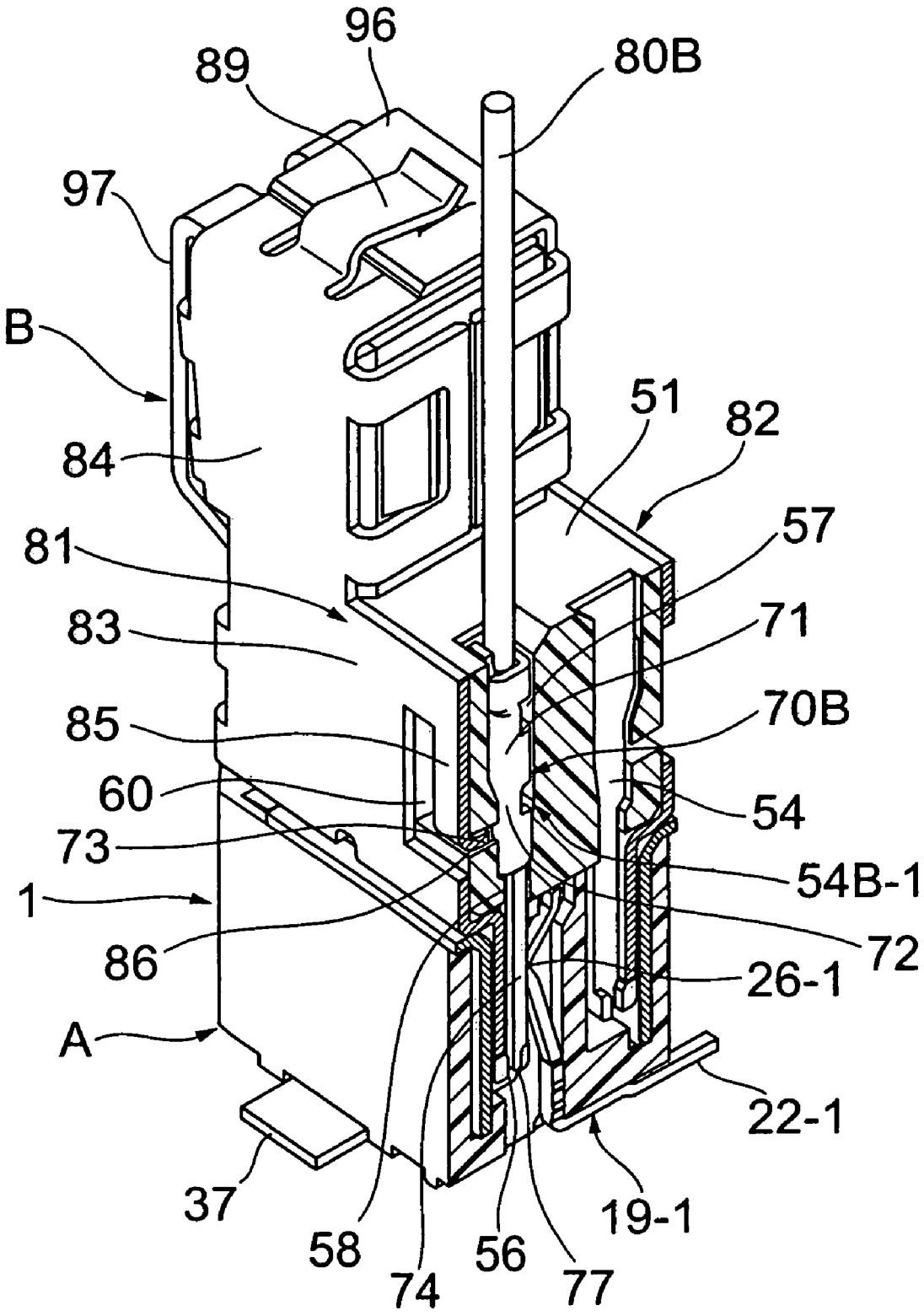
FIG. 2 is a perspective view of the multi way connector of FIG. 1, partly in section taken along a ground terminal.
Figure 3:
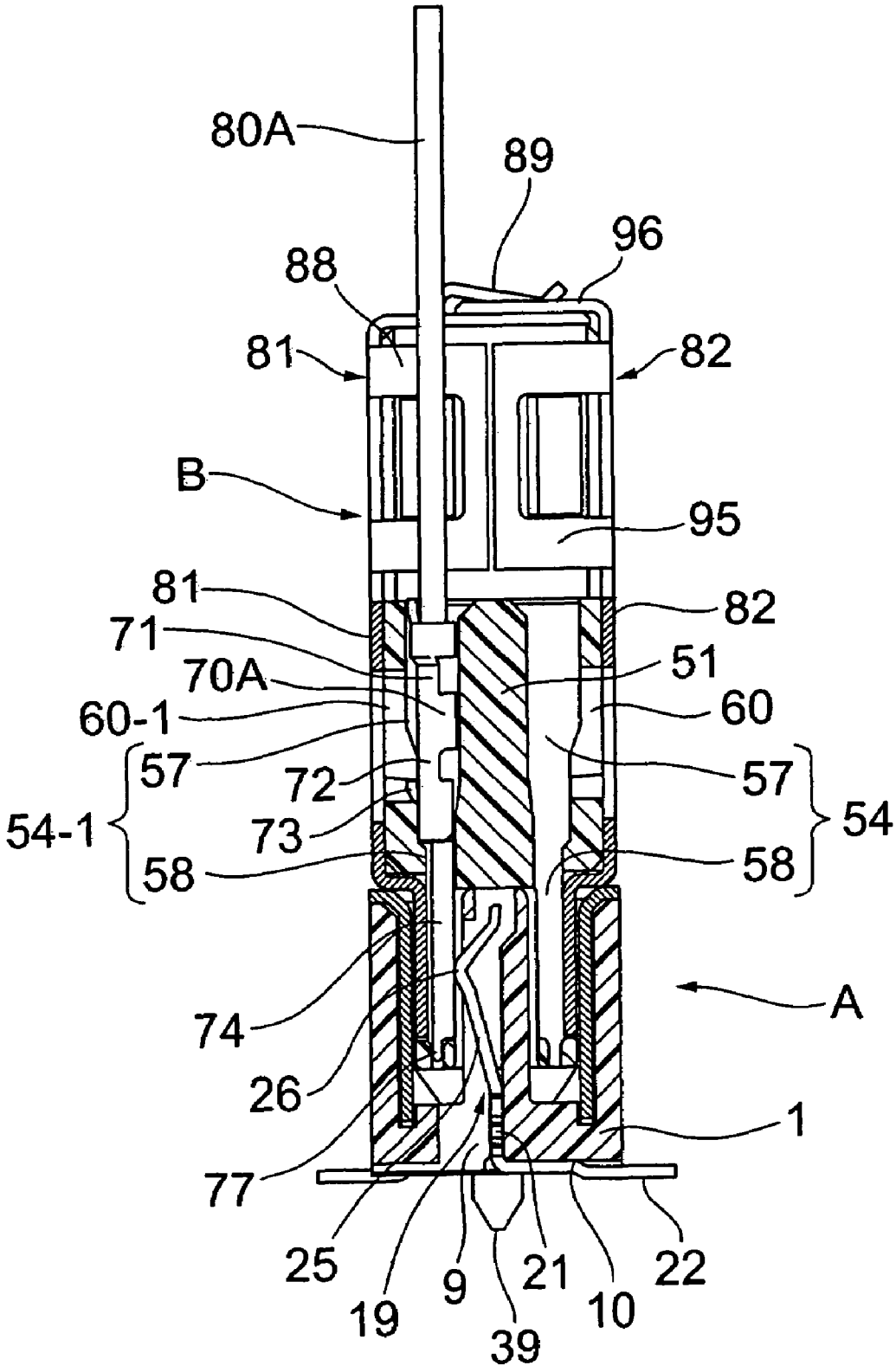
FIG. 3 is a cross-sectional view of the multi way connector of FIG. 1 taken along a signal terminal.

Also, as to the contact section 74, the contact portion 75 of is communicated to the back face 72*d* of the fixed portion 72. A side face 74*a* of the contact section 74 is communicated to the side face 72*c* of the fixed portion 72. An edge 74*e* of the other side face 74*c* of the contact section 74 abuts against the side face 72*b* of the fixed portion 72. The contact terminal 70 is composed of a signal and ground terminals. As shown in FIGS. 3 and 19, a signal terminal 70A is connected to an end portion of a signal cable 80A by the crimp portion 71. As shown in FIG. 2, a ground terminal 70B is connected to an end portion of a ground cable 80B by the crimp portion 71.

As shown in FIGS. 3 and 19, the signal terminal 70A is fitted in the signal terminal fit portion 54A-1. That is, the contact section 74 is inserted into the contact insertion portion 58, the fixed portion 72 is press-fitted in the terminal insertion portion 57, and the engagement projection 73 is engaged with an edge of the opening portion 60. At this point, the guide portion 59 is inserted into the guide groove 76 of the contact section 74, and a pair of the projection 77 of the contact portion 72 is inserted into a pair of the projecting insertion holes 56 (refer to FIGS. 22 and 25).

In the similar way, as shown in FIG. 2, the signal terminal 70B is fitted in the signal terminal fit portion 54B-1. That is, the contact section 74 is inserted into the contact insertion portion 58, the fixed portion 72 is press-fitted in the terminal insertion portion 57, and the engagement projection 73 is engaged with an edge of the opening portion 60-1. At this point, the guide portion 59 is inserted into the guide groove 76 of the contact section 74, and a pair of the projection 77 of the contact portion 72 is inserted into a pair of the projecting insertion holes 56 (refer to FIGS. 22 and 25).

Figure 17:
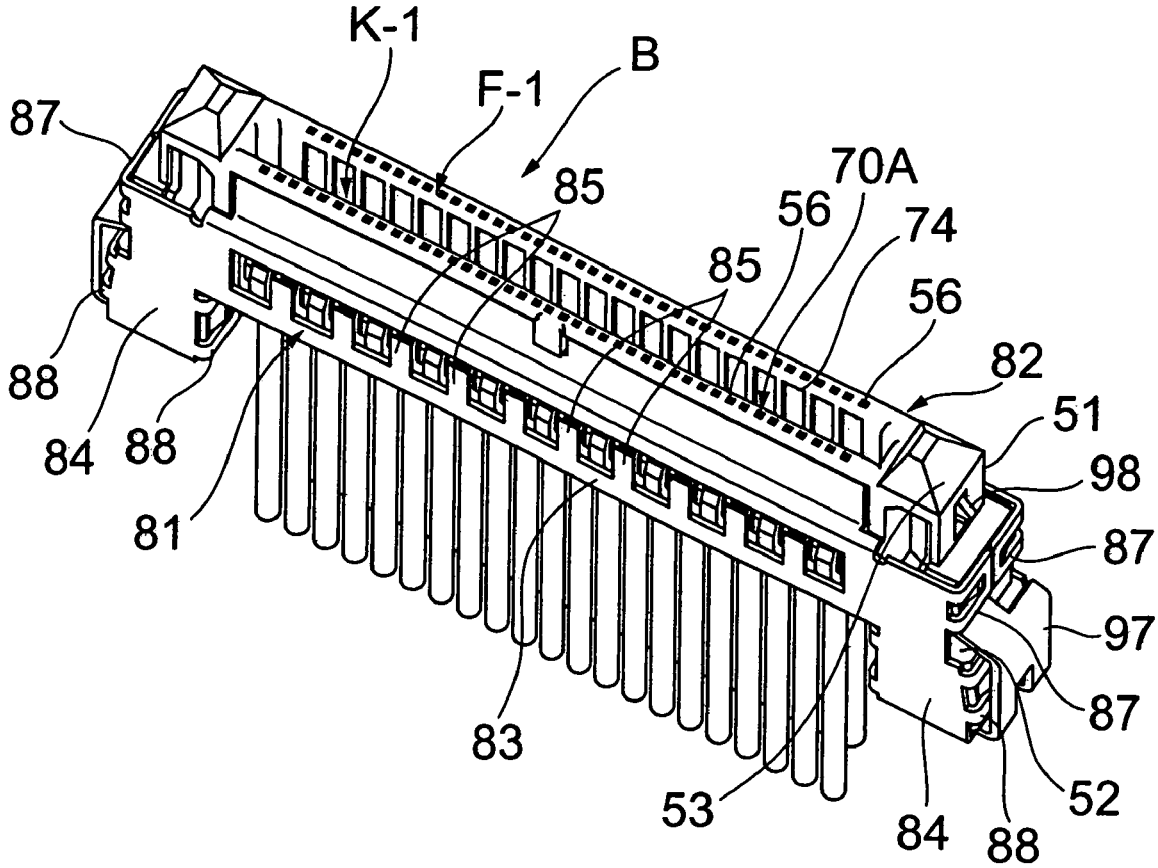
FIG. 17 is a perspective view of the cable connector seen from a mating connector plug-in section.
Figure 27:
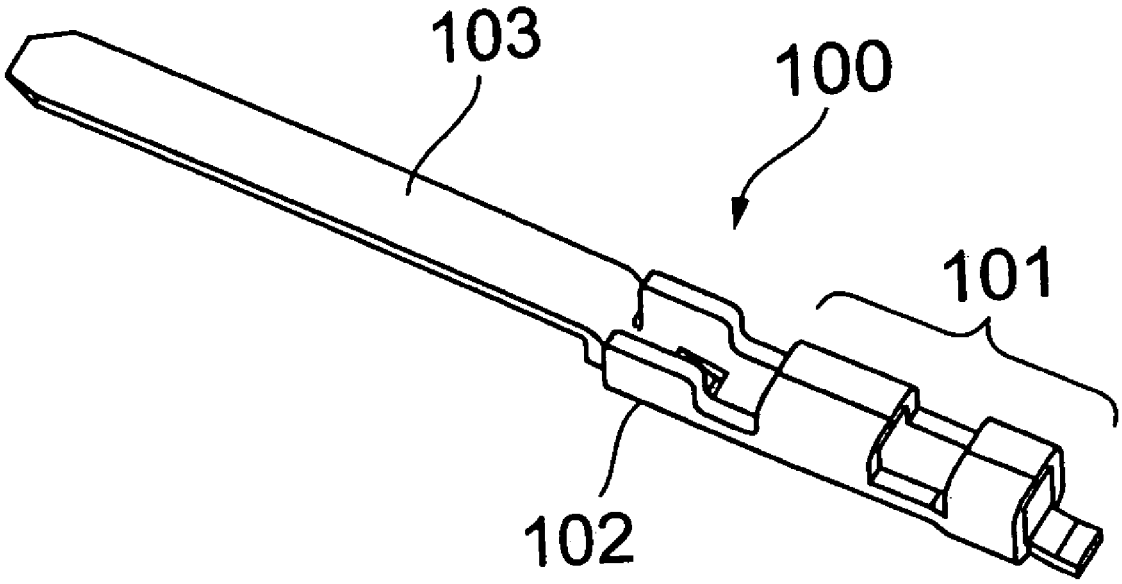
FIG. 27 PRIOR ART
FIG. 27 is a perspective view of a conventional crimp terminal.

A conventional crimp-style terminal 100 shown in FIG. 27 comprises a crimp portion 101, a fixed portion 102, and a contact portion 103. The fixed portion 102 has a sectional shape of ⊐and the contact portion 103 has a shape of a flat plate. The shield shell is composed of the shield member 81, which covers a substantially half of the surface of the crimp-style case 51, and the shield member 82, which covers substantially another half of the surface of the crimp-style case 51. As shown in FIG. 17, the shield member 81 has a main shield portion 83, which covers a side face of the crimp-style case 51. A pair of end shield portions 84 is provided at both sides of the main shield portion 83 to cover the holding portion 52 of the crimp-style case 51.

Figure 18:
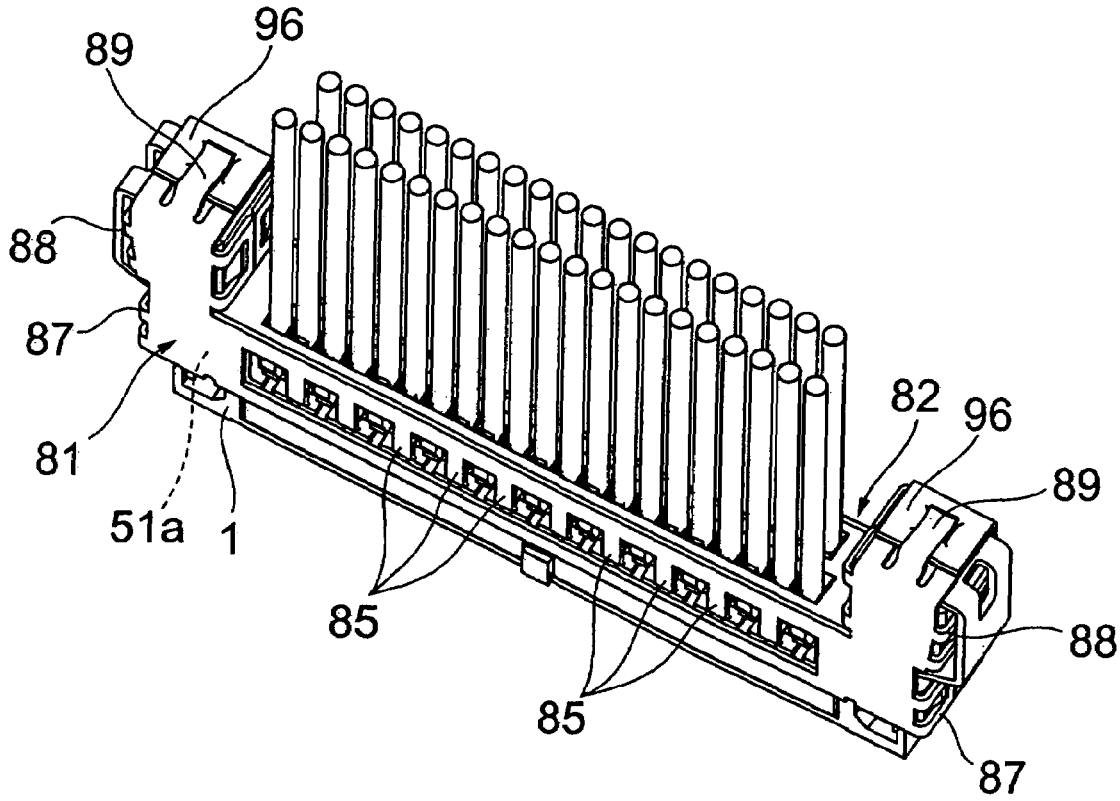
FIG. 18 is a perspective view of the cable connector of FIG. 17 seen from a cable side.

A plurality of ground terminal contact portions 85 having a shape of a tongue are provided in the main shield portion 83 in the longitudinal direction of the connector (FIG. 2). The top of the ground terminal contact portion 85 is bent to use as a contact point 86. Engagement pieces 87 are provided at side edges of the main shield portion 83. Engagement pieces 88 are provided at side edges of the end shield portion 84. Contact pieces 89 are provided at an end edge of the end shield portion 84 (FIGS. 2 and 18).

Figure 1:
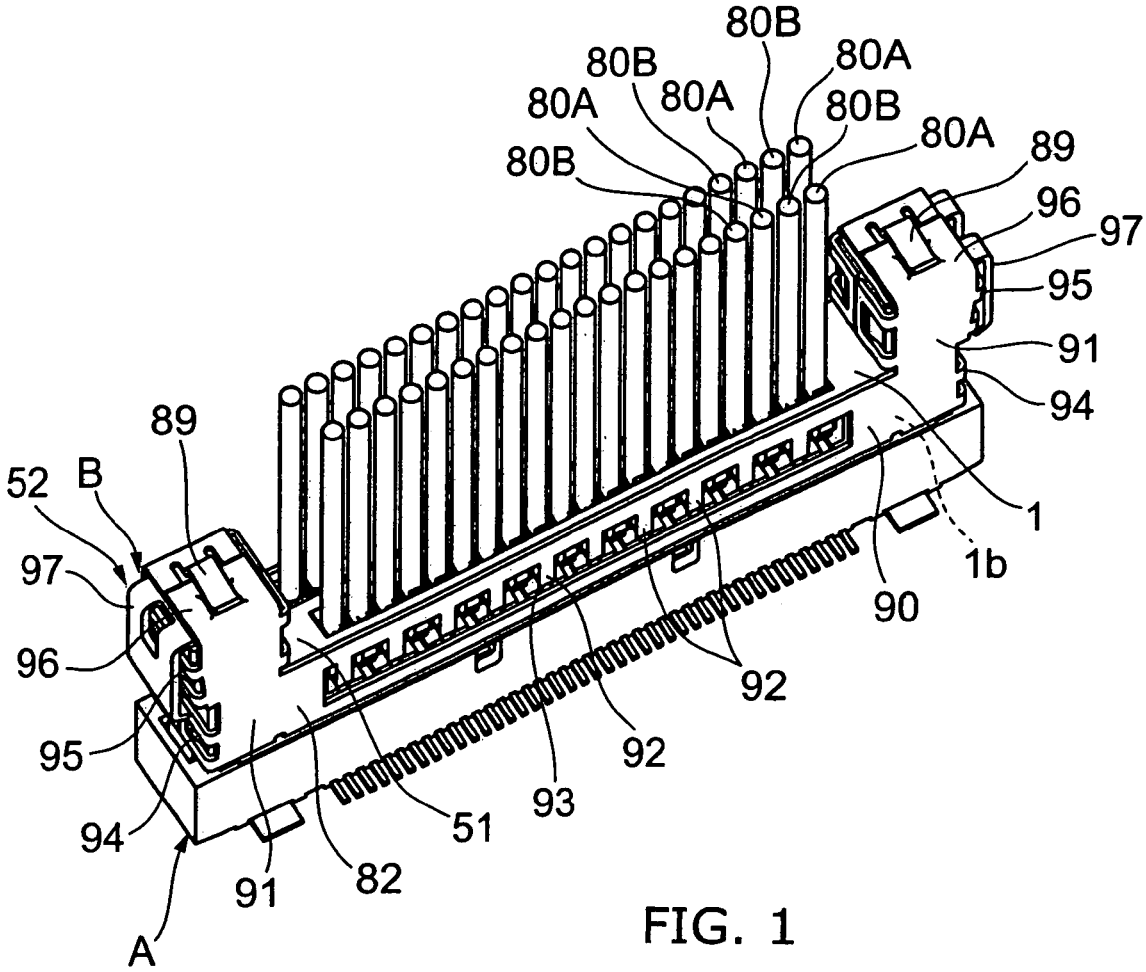
FIG. 1 is a perspective view of a multi way connector according to the present invention, wherein a receptacle connector and a cable connector are connected to each other.

As shown in FIG. 1, the shield member 82 has a main shield portion 90, which covers a side face of the crimp-style case 51. A pair of end shield portions 91 is provided at both sides of the main shield portion 90 to cover the holding portion 52 of the crimp-style case 51. A plurality of ground terminal contact portions 92 having a shape of a tongue are provided in the main shield portion 90 in the longitudinal direction of the connector. The top of the ground terminal contact portion 92 is bent to use as a contact point 93. Engagement pieces 94 are provided at side edges of the main shield portion 90. Engagement pieces 95 are provided at side edges of the end shield portion 91. Contact pieces 96 are provided at an end edge of the end shield portion 91.

The shield members 81 and 82 sandwich the crimp-style case 51 from both directions in the non-longitudinal direction of the connector to cover the crimp-style case 51. The shield member 81 is fitted in the crimp-style case 51 by engagement between the engagement pieces 87 and both ends of the crimp-style case 51 and engagement between the engagement pieces 88 of the end shield portion 84 and both ends of the holding portion 52 (FIG. 17). The shield member 82 is fitted in the crimp-style case 51 by engagement between the engagement pieces 94 and both ends of the crimp-style case 51 and engagement between the engagement pieces 95 of the end shield portion 91 and both ends of the holding portion 52. The contact pieces 89 and 96 of the shield members 81 and 82 are brought into contact to each other at end of the holding portion 52 for the purpose of conduction (FIG. 1).

As shown in FIG. 2, a plurality of the ground terminal contact portions 85 provided in the shield member 81 are inserted into the opening portion 60 of the crimp-style case 51 such that the contact points 86 on the top of the ground terminal contact portions 85 are brought into contact with the back face of the fixed portions 72 of the ground terminals 70B. Also, although not show in the drawings, a plurality of the ground terminal contact portions 92 provided in the shield member 82 are inserted into the opening portion 60-1 of the crimp-style case 51 such that the contact points 93 on the top of the ground terminal contact portions 92 are brought into contact with the back face of the fixed portions 72 of the ground terminals 70B.

Figure 26:
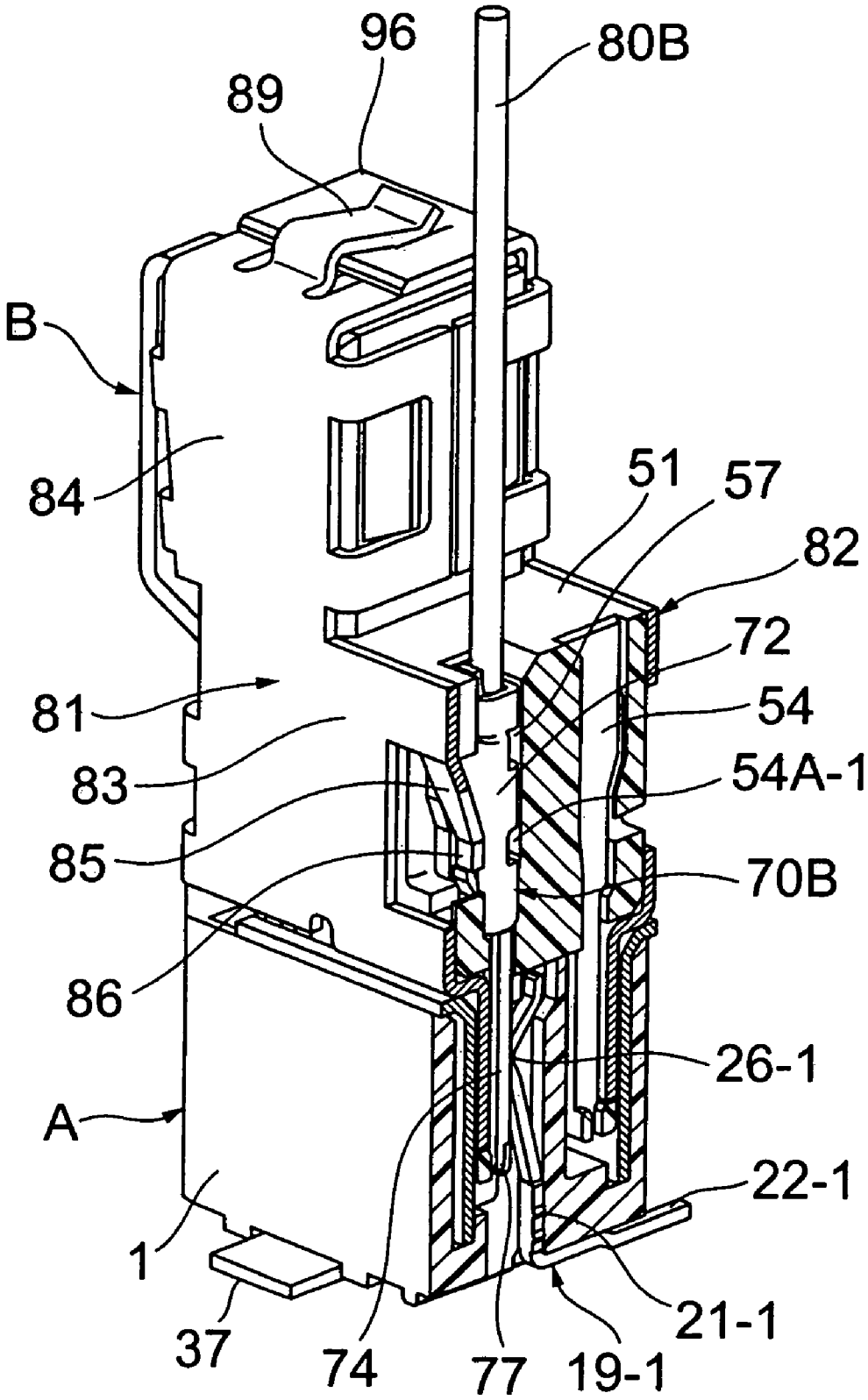
FIG. 26 is a perspective view of a multi way connector according to another embodiment of the present invention, wherein a shield shell of the cable connector has a shape different from that shown in FIG. 2.

As shown in FIG. 26, the ground terminal contact portions 85 and 92 can have a shape of a bent tongue to acquire a spring-property and the contact point 86 can have a flat surface so as to be brought into contact with the back face of the fixed portion 72 of the ground terminal 72B.

As shown in FIG. 17, a lock operation lever 97 is provided outside the holding portion 52 of the cable connector B. A lock projection 98 is provided on the top of the lock operation lever 97 and projects from the insulation case 51 into the outside by spring force of the lock operation lever 97. The connection and release of the receptacle and cable connectors A and B will now be described below.

As shown in FIGS. 4, 5, 17, and 18, when the connector plug-in section F-1 of the cable connector B is plugged in the connector plug-in section F of the receptacle connector A, the guide post 53 is inserted into the guide hole 39, the contact portions 74 of a plurality of the signal terminals of the cable connector B are brought into contact with the contact points 26 and 26-1 of the contact portions 25 and 25-1 of a plurality of the signal terminals of the receptacle connector A. Also, the shield shell (the shield members 81 and 82) is brought into contact with the shield plate 30 of the receptacle connector A. With this condition, the lock projection 98 is inserted into the lock hole 31A so that the cable connector B is connected to the receptacle connector A. For the release of the connection between the receptacle and cable connectors A and B, the lock operation lever 97 is pressed to unlock the lock projection 98 from the lock hole 31A, then, the cable connector B is pulled out.

As fully described above, according to the embodiment of the present invention, (1) the connector plug-in section F is formed in the front face of the insulation case 1 and has two rows of the plug-in spaces K, which extends in the longitudinal direction of the connector and sandwiches the plug-in protrusion 3, (2) the plug-in protrusion 3 comprises a plurality of the terminal fit portions 11, which are opened to one of the plug-in spaces K, and a plurality of the terminal fit portions 11-1, which are opened to the other of the plug-in spaces K, wherein the terminal fit portions 11 and 11-1 are alternately provided at predetermined intervals in the longitudinal direction of the connector, (3) the contact terminals 19 are fitted in the terminal fit portions 11 such that the contact portions 25 thereof are exposed to the one of the plug-in spaces K, and the contact terminals 19-1 are fitted in the terminal fit portions 11-1 such that the contact portions 25-1 thereof are exposed to the other of the plug-in spaces K, wherein the contact terminals 19 and 19-1 have the same length of transmission path, (4) the lead portions 22 and 22-1 of the respective contact terminals 19 and 19-1 are provided at predetermined intervals in the longitudinal direction of the connector such that the respective leads portions 22 and 22-1 project into the outside of the insulation case 1 in the same direction of the non-longitudinal direction of the connector, (5) a pair of the contact terminal 19 and the contact terminal 19-1 constitutes the signal terminal, and another pair of the contact terminal 19 and the contact terminal 19-1 constitutes the ground terminal, (6) the signal and ground terminals are provided alternately in the longitudinal direction of the connector so that the interval of the lead portions (mounted portions) 22 and 22-1 becomes a half of the interval of the contact portions 25 and 25-1 of the signal and ground terminals. Consequently, even if the receptacle connector A is multi way type, since the intervals between the lead portions (mounted portions) are made a half of the intervals between the contact portions of the contact terminals (signal and ground terminals), the receptacle connector A does not become large in the longitudinal direction (a direction of pitch or arrangement of the contacts) of the connector, thus making the mount area small. Also, since the interval of the contact portions 25 and 25-1 of the signal and ground terminals can be designed large, the crimp-style cable connector B becomes applicable as a mating connector.

Further, since the thickness in a widthwise direction (non-longitudinal direction of the connector) of the receptacle connector A can be designed large to increase the strength of the receptacle connector A so that the working efficiency upon insertion and removal of the cable connector B is increased, a mating connector of a board mount type is applicable, and the connection method is diversified including a vertical mount. Even if the thickness of the receptacle connector A becomes large, the size of the receptacle connector A represented by the width×the length (a dimension of the non-longitudinal direction×a dimension of the longitudinal direction) of the receptacle connector A is made relatively small with respect to the conventional connector.

According to an embodiment of the present invention, the contact terminal 19 comprise the press-fit fixing portion 21, the lead portion 22 extending from the end of the press-fit fixing portion 21, and the contact portion 25 extending from the other end of the press-fit fixing portion 21. The contacts portion 25 has a contact 26 at a curved point thereof. The lead portion 22 is bent at substantially right angles with respect to the press-fit fixing portion 21 on the same side as the side of the contact 26. The contact terminal 19-1 comprise the press-fit fixing portion 21-1, the lead portion 22-1 extending from the end of the press-fit fixing portion 21-1, and the contact portion 25-1 extending from the other end of the press-fit fixing portion 21-1. The contacts portion 25-1 has a contact 26-1 at a curved point thereof. The lead portion 22-1 is bent at substantially right angles with respect to the press-fit fixing portion 21-1 on the side opposite to the side of the contact 26. The length of the transmission path of the contact terminal 19 is the same as that of the contact terminal 19-1.

In the differential signal transmission of high speed signal, signals having opposite phases from each other are transmitted in a pair of signal transmission lines to take the difference between the phases of the two signals, thereby to strengthen the resistance to noise from the outside. The defective point of the differential signal transmission is that when common mode components are superimposed or overlapped with each other, the electromagnetic radiation noise is increased. One of reasons of generation of the common mode components is that the distal ends of the pair of the lines are inconsistent. An example of the inconsistency is a mismatching length of the pair of the lines. In the present invention, since the contact terminals 19 and 19-1 have the same length of the transmission lines, it is possible to eliminate the inconsistency of the mismatching length.

According to another embodiment of the present invention, (1) the connector plug-in section F-1 of the mating connector has the plug-in hollow K-1 in the front face of the insulation case 51 or crimp-style case 51 and the two walls 51*a* and 51*b* standing at the sides in the non-longitudinal direction of the connector and sandwiching the plug-in hollow K-1, (2) the wall 51*a* comprises a plurality of the mating terminal fit portions 54 and 54-1, both of which are opened to the plug-in hollow K-1, wherein the terminal fit portions 54 and 54-1 are alternately provided at predetermined intervals in the longitudinal direction of the connector, (3) ones of the mating contact terminals 70, or first contact terminals 70 are fitted in the terminal fit portions 54 such that the contact portions 75 thereof are exposed to the plug-in hollow K-1, and the others of the contact terminals 70, or second contact terminals 70 are fitted in the terminal fit portions 54-1 such that the contact portions 75 thereof are exposed to the plug-in hollow K-1, wherein the first and second contact terminals 70 have the same transmission length, (4) a pair of the first and second contact terminals 70 constitutes the signal terminal 70A, and another pair of the first and second contact terminal 70 constitutes the ground terminal 70B, (5) the signal and ground terminals 70A and 70B are provided alternately in the longitudinal direction of the connector. Consequently, since the interval of the contact portions 75 of the signal and ground terminals 70A and 70B can be designed large, the crimp-style cable connector B becomes applicable as a mating connector of the receptacle connector A.

The front side of the contact insertion portion 58 is closed. A pair of the projection insertion holes 56 is provided in the closed area of the contact insertion portion 58 and the guide portion 59 projects from the contact insertion portion 58. The contact section 74 has a sectional shape of ⊐and comprises the guide groove 76 inside it and a pair of the projections 77 at the top end thereof. When the contact terminals 70 are inserted into the mating terminal fit portions 54 and 54-1, the guide portion 59 is inserted into the guide groove 76, and the projections 77 are inserted into the projection insertion holes 56. Since the contact section 74 has a sectional shape of ⊐to increase the strength so that when the contact section 74 is inserted into the contact insertion portion 58, buckling and deformation are prevented and the working efficiency of harness is increased.

Also, when the contact terminals 70 are fitted in the mating terminal fit portions 54 and 54-1, since the guide portion 59 is inserted into the guide groove 76, the contact section 74 is easily inserted into the contact insertion portion 58. When the cable connector B is connected to the receptacle connector A, since the projections 77 are inserted into the projection insertion holes 56, buckling and deformation caused by fall of the connector B is prevented.

According to the embodiment of the invention, since the fixed portion 72 and the contact section 74 are made by bending a sheet metal and the fixed portion 72 has a closed sectional shape of a quadrilateral frame to increase the strength, when the contact section 74 is inserted into the contact insertion portion 58, buckling and deformation are prevented and the working efficiency of the harness is increased.

The receptacle connector A comprises the shield plate 30 in the connector plug-in section K and the cable connector B comprises the shield shell covering the connector plug-in section K-1. The ground terminal contact portions 85 and 92 of the shield shell are inserted into the terminal fit portions 54 and 54-1 and brought into contact with the ground terminals 70B provided in the terminal fit portions 54 and 54-1. Thus, the ground terminals 70B are easily brought into contact with the shield shell.

In the embodiments of the present invention, a plurality of the terminal fit portions 11 and 11-1 are alternately provided in the plug-in section 3 at predetermined intervals in the longitudinal direction of the connector and opened to either of the two plug-in spaces K-1, respectively, and the contact terminals 19 and 19-1 having the same length of the transmission path are fitted in the terminal fit portions 11 and 11-1. However, the contact terminals 19 and 19-1 may be integrally fixed to the plug-in section 3 by insertion molding.

According to the present invention, unless the interval between the contact portions of the contact terminals, such as the signal and ground terminals, is changed, the interval between the lead portions (mount portions) can be made a half of that of the contact portions so that even if the connector has multi way, the size of the connector in the longitudinal direction of the connector (direction of the pitch of the contacts) does not become large and the mount area becomes small. Also, since the interval of the contact portions of the contact terminals can be designed large, the crimp-style cable connector becomes applicable as a mating connector. Further, since the thickness in a widthwise direction (non-longitudinal direction of the connector) of the connector can be designed large to increase the strength of the connector, the working efficiency upon insertion and removal of the mating connector is increased, a board mount type connector is applicable as the mating connector, and the connection method is diversified including a vertical mount. For the above reasons, the present invention is applicable for a multi way connector, which includes a receptacle connector and a cable mating connector and is used for transmitting an electrical signal from a equipment body to an electronic apparatus, such as an LCD panel.

The invention claimed is:

1. A multi way connector comprising a connector and a mating connector, said connector including:

an insulation case;

a connector plug-in section provided in said insulation case;

a plug-in protrusion provided in a front face of said insulation case;

two rows of plug-in spaces provided in a longitudinal direction of said connector and sandwiching said plug-in protrusion;

a plurality of first terminal fit portions provided in said plug-in protrusion and opened to one row of said plug-in spaces;

a plurality of second terminal fit portions provided in said plug-in protrusion and opened to the other row of said plug-in spaces, wherein said first and second terminal fit portions are alternately provided at a predetermined interval in said longitudinal direction of said connector;

a plurality of first contact terminals fitted in said first terminal fit portions and having first contact portions exposed to said one of said plug-in spaces and first lead portions provided at said predetermined interval in said longitudinal direction of said connector; and a plurality of second contact terminals fitted in said second terminal fit portions and having second contact portions exposed to said other of said plug-in spaces and second lead portions provided at said predetermined interval in said longitudinal direction of said connector, wherein said first and second lead portions project on the same side in a non-longitudinal direction of said connector, said mating connector including:

a mating insulation case;

a mating connector plug-in section provided in said mating insulation case;

a plurality of first mating contact terminals provided in said mating connector plug-in section; and a plurality of second mating contact terminals provided in said mating connector plug-in section, wherein said mating connector plug-in section is plugged in said connector plug-in section so that said first and second contact terminals are brought into contact with said mating first and second contact terminals, respectively, for conduction therebetween.

2. The multi way connector according to claim 1, wherein a pair of said first and second contact terminals constitutes a signal terminal and another pair of said first and second contact terminals constitutes a ground terminal, said signal and ground terminals being alternately provided in said longitudinal direction of said connector.

3. The multi way connector according to claim 1, wherein said first and second contact terminals have the same length of transmission path, and each of said first contact terminals comprises:

a first press-fit fixing portion, said first contact portion extending from an end of said first press-fit fixing portion and having a first contact at a curved point thereof, and said first lead portion extending from the other end of said first press-fit fixing portion and bent at substantially right angles with respect to said first press-fit fixing portion on a side same as a side of said first contact, and each of said second contact terminals comprises:

a second press-fit fixing portion, said second contact portion extending from an end of said second press-fit fixing portion and having a second contact at a curved point thereof, and said second lead portion extending from the other end of said second press-fit fixing portion and bent at substantially right angles with respect to said second press-fit fixing portion on a side opposite to a side of said second contact.

4. The multi way connector according to claim 1, wherein said mating connector further comprises:

a plug-in hollow provided in a front face of said mating insulation case;

a first wall and a second wall standing at sides in a non-longitudinal direction of said mating connector such that said first and second walls sandwich said plug-in hollow;

a plurality of first mating terminal fit portions provided in said first wall at a predetermined interval in a longitudinal direction of said mating connector and opened to said plug-in hollow; and a plurality of second terminal fit portions provided in said second wall at said predetermined interval in said longitudinal direction of said mating connector and opened to said plug-in hollow, wherein said first mating contact terminals are fitted in said first mating terminal fit portions and having first contact portions exposed to said plug-in hollow, and said second mating contact terminals are fitted in said second mating terminal fit portions and having second contact portions exposed to said plug-in hollow, said first and second mating contact terminals having the same length of transmission path.

5. The multi way connector according to claim 4, wherein a pair of said first and second mating contact terminals constitutes a mating signal terminal and another pair of said first and second mating contact terminals constitutes a mating ground terminal, said mating signal and ground terminals being alternately provided in said longitudinal direction of said mating connector.

6. The multi way connector according to claim 5, wherein said connector plug-in section of said connector has a shield plate therein and said mating connector pug-in section of said mating connector is covered by a shield shell having ground terminal contact portions, which are inserted into said first and second mating terminal fit portions to be brought into contact with said mating ground terminal.

7. The multi way connector according to claim 4, wherein each of said first and second mating contact terminals is a crimp-style and comprises a crimp portion connecting said each of said first and second mating contact terminals to an end portion of a cable by a crimp, a fixed portion extending from said crimp portion, and a contact section extending from said fixed portion and brought into contact with each of said first and second contacts of said first and second contact terminals, wherein each of said first and second mating terminal fit portions comprises a terminal insertion portion, to which said fixed portion is fixed, and a contact insertion portion provided in said first or second wall along a direction of insertion of said mating connector, into which said contact section is inserted, thus fitting said first and second mating contact terminals in said first and second mating terminal fit portions, respectively.

8. The multi way connector according to claim 7, wherein said contact insertion portion comprises a guide portion and a pair of projection insertion holes in a closed top side thereof, and said contact section having a sectional shape of ∃comprises a guide groove thereinside and a pair of projections on a top side thereof, and wherein when said first and second mating contact terminals are fitted in said first and second terminal fit portions, said guide portion is inserted into said guide groove and said projections are inserted into said projection insertion holes.

9. The multi way connector according to claim 8, wherein said fixed portion and contact section are made by bending a sheet metal, said fixed portion having a closed sectional shape of a quadrilateral frame.

10. A multi way connector comprising a connector and a mating connector, said connector including:

an insulation case;

a connector plug-in section provided in said insulation case;

a plug-in protrusion provided in a front face of said insulation case;

two rows of plug-in spaces provided in a longitudinal direction of said connector and sandwiching said plug-in protrusion;

a plurality of first contact terminals formed integrally by insertion molding in said plug-in protrusion and exposed to one row of said plug-in spaces, each of said first contact terminals having a lead portion; and a plurality of second contact terminals formed integrally by insertion molding in said plug-in protrusion and exposed to said other row of said plug-in spaces, each of said second contact terminals having a lead portion, wherein said first and second contact terminals have the same length of transmission path and are alternately provided at a predetermined interval in said longitudinal direction of said connector, and said first and second lead portions project on the same side in a non-longitudinal direction of said connector, said mating connector including:

a mating insulation case;

a mating connector plug-in section provided in said mating insulation case;

a plurality of first mating contact terminals provided in said mating connector plug-in section; and a plurality of second mating contact terminals provided in said mating connector plug-in section, wherein said mating connector plug-in section is plugged in said connector plug-in section so that said first and second contact terminals are brought into contact with said first and second mating contact terminals, respectively, for conduction therebetween.

* * * * *